US006951272B2

(12) United States Patent
Ohno et al.

(10) Patent No.: US 6,951,272 B2
(45) Date of Patent: Oct. 4, 2005

(54) SIGNATURE-STACKING APPARATUS

(75) Inventors: Kinichiroh Ohno, Machida (JP); Tadashi Hachiya, Takarazuka (JP)

(73) Assignee: Tokyo Kikai Seisakusho, Ltd., Tokyo (JP)

( * ) Notice: Subject to any disclaimer, the term of this patent is extended or adjusted under 35 U.S.C. 154(b) by 0 days.

(21) Appl. No.: 10/941,836

(22) Filed: Sep. 16, 2004

(65) Prior Publication Data

US 2005/0139454 A1 Jun. 30, 2005

(30) Foreign Application Priority Data

Dec. 26, 2003 (JP) ..... 2003-433597

(51) Int. Cl.[7] ..... B65G 49/00

(52) U.S. Cl. ..... 198/644; 198/470.1; 414/790.6; 414/792.7; 414/792.9; 414/793.1

(58) Field of Search ..... 198/470.1, 644, 198/417, 803.3; 414/789.6, 789.9, 790.6, 791.1, 792.7, 792.9, 793.1, 794.4

(56) References Cited

U.S. PATENT DOCUMENTS

| | | | | | |
|---|---|---|---|---|---|
| 3,206,043 | A | * | 9/1965 | Kile | 198/347.1 |
| 3,239,214 | A | * | 3/1966 | Rauschenberger | 198/644 |
| 3,255,895 | A | * | 6/1966 | Klingler | 414/793.1 |
| 3,617,055 | A | * | 11/1971 | Stal | 414/788.9 |
| 5,772,391 | A | * | 6/1998 | Sjogren et al. | 414/790.9 |
| 5,913,656 | A | * | 6/1999 | Collins | 414/789.6 |
| 6,039,317 | A | * | 3/2000 | Kramer | 198/470.1 |

FOREIGN PATENT DOCUMENTS

| | | |
|---|---|---|
| JP | 6-64819 | 3/1994 |
| JP | 6-156855 | 6/1994 |
| JP | 7-35216 | 4/1995 |
| JP | 2533825 | 6/1996 |
| JP | 3132907 | 11/2000 |
| JP | 2001-63888 | 3/2001 |
| JP | 3249137 | 11/2001 |
| JP | 2003-40511 | 2/2003 |

* cited by examiner

*Primary Examiner*—James R. Bidwell
(74) *Attorney, Agent, or Firm*—Westerman, Hattori, Daniels & Adrian, LLP

(57) ABSTRACT

In a signature-stacking apparatus, a conveyor chain holding a row of signatures travels along a conveyance path. A first signature release section and a second signature release section are provided in the conveyance path. During travel from the first signature release section to the second signature release section, the conveyor chain is twisted by 180 degrees about the direction of travel and makes a 180-degree turn about an axis parallel to a connection pin of the conveyor chain. Signatures released from the first and second signature release sections are conveyed to first and second signature delivery sections disposed on opposite sides of a stacking section by first and second conveyor mechanisms while their speed of conveyance is being adjusted. A predetermined number of signatures are delivered, while being led by their creases, into the stacking section from the first and second signature delivery sections alternately.

10 Claims, 13 Drawing Sheets

SIGNATURE-STACKING APPARATUS

BACKGROUND OF THE INVENTION

1. Field of the Invention

The present invention relates to a signature-stacking apparatus in which signatures delivered from, for example, a folding unit of a rotary printing press are conveyed to a stacking section by means of a conveyor chain having gripping mechanisms conveys; groups of signatures, each group consisting of a predetermined number of signatures whose creases face the same direction, are stacked in the stacking section such that the direction in which the creases of signatures face alternates from group to group; and the thus-formed stack of signatures is delivered from the apparatus.

2. Description of the Related Art

A conventional signature-stacking apparatus is disclosed in, for example, Japanese Patent No. 2533825.

The disclosed signature-stacking apparatus is configured as follows. Conveying means (hereinafter referred to as a "conveyor chain") having holding means (hereinafter referred to as "gripping mechanisms") for gripping corresponding signatures conveys signatures to stacking means (hereinafter referred to as a "stacking section") for stacking signatures. On the way to the stacking section, the gripping mechanisms in a predetermined number pivotally change their orientation clockwise or counterclockwise by a predetermined angle; for example, 90 degrees. Then, the gripping mechanisms release corresponding signatures one after another, so that the released signatures fall into the stacking section located below the release point. Groups of signatures, each group consisting of a predetermined number of signatures whose creases face the same direction, are stacked such that the direction in which the creases of signatures face alternates from group to group by two times the predetermined angle; for example, by 180 degrees. Thus is formed a stack of signatures.

A gripping mechanism grips a signature at the so-called crease side where a single crease is externally present, since a plurality of leaf ends are arranged in layers at the so-called leaf-end side of the signature and are difficult to grip without one or more leaf ends being left ungripped. Therefore, the signature falls into the stacking section while being led by the leaf-end side.

The signature-stacking apparatus disclosed in Japanese Patent No. 2533825 involves the following problems.

As mentioned above, a signature released from a gripping mechanism falls gravitationally while being led by the leaf-end side. In the course of falling, air resistance may cause leaf ends to fan out or bend, potentially decelerating the falling speed and causing a variation in falling speed. As a result, two adjacently falling signatures may contact each other. Therefore, signatures encounter difficulty in falling in a stable condition and are consequently stacked in a misaligned condition, potentially raising a problem in a later step of working a stack of signatures; for example, in a packing or binding step.

When signatures fall while their leaf ends fan out or bend, and are then stacked, leaves of the stacked signatures may be folded, resulting in impaired quality. Deceleration of falling speed is an obstacle to speeding up a step of working signatures.

In order to change the orientation of signatures, the gripping mechanisms are rotated 90 degrees about the vertical direction and are slid in a direction perpendicular to both the vertical direction and the direction of conveyance. Thus, the conveying means, which is composed of the conveyor chain and the gripping mechanisms, must employ a complicated mechanism for effecting a gripping action and an orientation-changing action. As a result, the possibility of malfunctioning increases. Also, since relatively frequent maintenance is required, running cost increases.

SUMMARY OF THE INVENTION

An object of the present invention is to solve the above-mentioned problems in the conventional signature-stacking apparatus and to provide a signature-stacking apparatus in which signatures are delivered into a stacking section while being led by their crease side while a certain delivery speed is imparted thereto, to thereby prevent deceleration of falling speed and fanning or bending of leaf ends of individual signatures; and groups of signatures, each group consisting of a predetermined number of signatures whose creases face the same direction, are stacked at high speed and in an aligned condition such that the direction in which the creases of signatures face alternates from group to group by 180 degrees, to thereby prevent occurrence of a problem in a later step of working a stack of signatures and avoid deteriorating the quality of stacked signatures.

To achieve the above object, the present invention provides a signature-stacking apparatus in which a conveyor chain having a plurality of gripping mechanisms for holding corresponding signatures, and a guide member for guiding travel of the conveyor chain form a conveyance path for conveying signatures; the traveling conveyor chain conveys signatures held by the corresponding gripping mechanisms to a predetermined position on the conveyance path and releases the signatures from the corresponding gripping mechanisms at the position; the released signatures are stacked in a stacking section; and a stack of signatures is delivered from the stacking section. A predetermined number of released signatures whose creases face the same direction fall into the stacking section while being led by their creases. The direction in which the creases of signatures face alternates every time the predetermined number of signatures fall into the stacking section.

In order to smoothly perform the above-mentioned stacking operation, the signature-stacking apparatus of the present invention comprises:

(a) a first signature release section and a second signature release section disposed in this sequence in the conveyance path with a certain distance of conveyance present therebetween;

(b) a guide member for guiding the conveyor chain, in a portion of the conveyance path between the first signature release section and the second signature release section, the guide member being twisted by 180 degrees about the direction of travel of the conveyor chain and being curved such that the direction of conveyance of the conveyor chain makes a 180-degree turn about an axis parallel to a connection pin of the conveyor chain;

(c) a first signature delivery section corresponding to the first signature release section, and a second signature delivery section corresponding to the second signature release section;

(d) a stacking section having a stacking space, an opening portion of the stacking space facing the first and second signature delivery sections, and the stacking section including a table mechanism adapted to receive and stack thereon signatures delivered into the stacking space and being vertically movable within the stacking space, a temporary reception mechanism provided above a signature-stacking surface of the table mechanism and adapted to temporarily receive signatures delivered into the stacking space from the first and second signature delivery sections, and a delivery mechanism for delivering signatures stacked on the signature-stacking surface of the table mechanism from the stacking space to the outside of the apparatus;

(e) a first conveyor mechanism disposed between the first signature delivery section and a position located under the first signature release section, and a second conveyor mechanism disposed between the second signature delivery section and a position located under the second signature release section, the first conveyor mechanism conveying the signatures released from the first signature release section, and the second conveyor mechanism conveying the signatures released from the second signature release section, the first conveyor mechanism and the second conveyor mechanism being provided such that time between arrival at the first signature release section of a signature to be released from the first signature release section and delivery of the signature from the first signature delivery section is substantially equal to time between arrival at the first signature release section of a signature to be released from the second signature release section and delivery of the signature from the second signature delivery section after the signature passes the first signature release section, and in such a manner as to allow adjustment thereof for preventing interference in the course of delivery between a signature delivered last from one signature delivery section and a signature delivered first from the other signature delivery section; and (f) means for rendering time between arrival at the first signature release section of a signature to be released from the first signature release section and delivery of the signature from the first signature delivery section substantially equal to time between arrival at the first signature release section of a signature to be released from the second signature release section and delivery of the signature from the second signature delivery section after the signature passes the first signature release section, as well as preventing interference in the course of delivery between a signature delivered last from one signature delivery section and a signature delivered first from the other signature delivery section; i.e., means for selectively controlling the first conveyor mechanism or the second conveyor mechanism so as to temporarily reduce its operating speed, or a braking mechanism for temporarily braking conveyance of signatures conveyed on the first or second conveyor mechanism, such as a stopper mechanism for stopping conveyance of signatures or a deceleration mechanism for decelerating conveyance of signatures.

The present invention yields effects described below.

In the stacking of signatures in the stacking section, the signatures are delivered into a stacking space from opposite sides of the opening portion of the stacking space while being led by their crease side while a certain delivery speed is imparted thereto. Thus, in the course of falling into the stacking space, the signatures are free from fanning or bending of their leaf ends which could otherwise result from air resistance. Also, groups of signatures, each group consisting of a predetermined number of signatures whose creases face the same direction, can be stacked such that the direction in which the creases of signatures face changes alternately from group to group by 180 degrees.

Thus, signatures can fall in the stacking space at high, constant speed, so that the signatures can be stacked at high speed synchronously with high-speed operation of a rotary printing press.

Signatures can be stacked in an aligned condition, thereby preventing occurrence of a problem in a later step which could otherwise result from a failure to stack signatures in an aligned condition. Also, stacked signatures are free from deteriorated quality, which could otherwise result from a folded leaf or leaves of a signature(s).

Furthermore, while signatures are being conveyed, the signatures do not need to change their orientation in relation to the direction of conveyance. In other words, the gripping mechanisms effect only a gripping action and thus can be simplified. Therefore, the gripping mechanisms are unlikely to malfunction and do not require frequent maintenance, so that running cost is decreased.

BRIEF DESCRIPTION OF THE DRAWINGS

Various other objects, features and many of the attendant advantages of the present invention will be readily appreciated as the same becomes better understood by reference to the following detailed description of the preferred embodiments when considered in connection with the accompanying drawings in which:

FIGS. 10A, 10B, and 10D are sectional front views, and FIG. 10C is a sectional side view;

DESCRIPTION OF THE PREFERRED EMBODIMENTS

Figure 1:
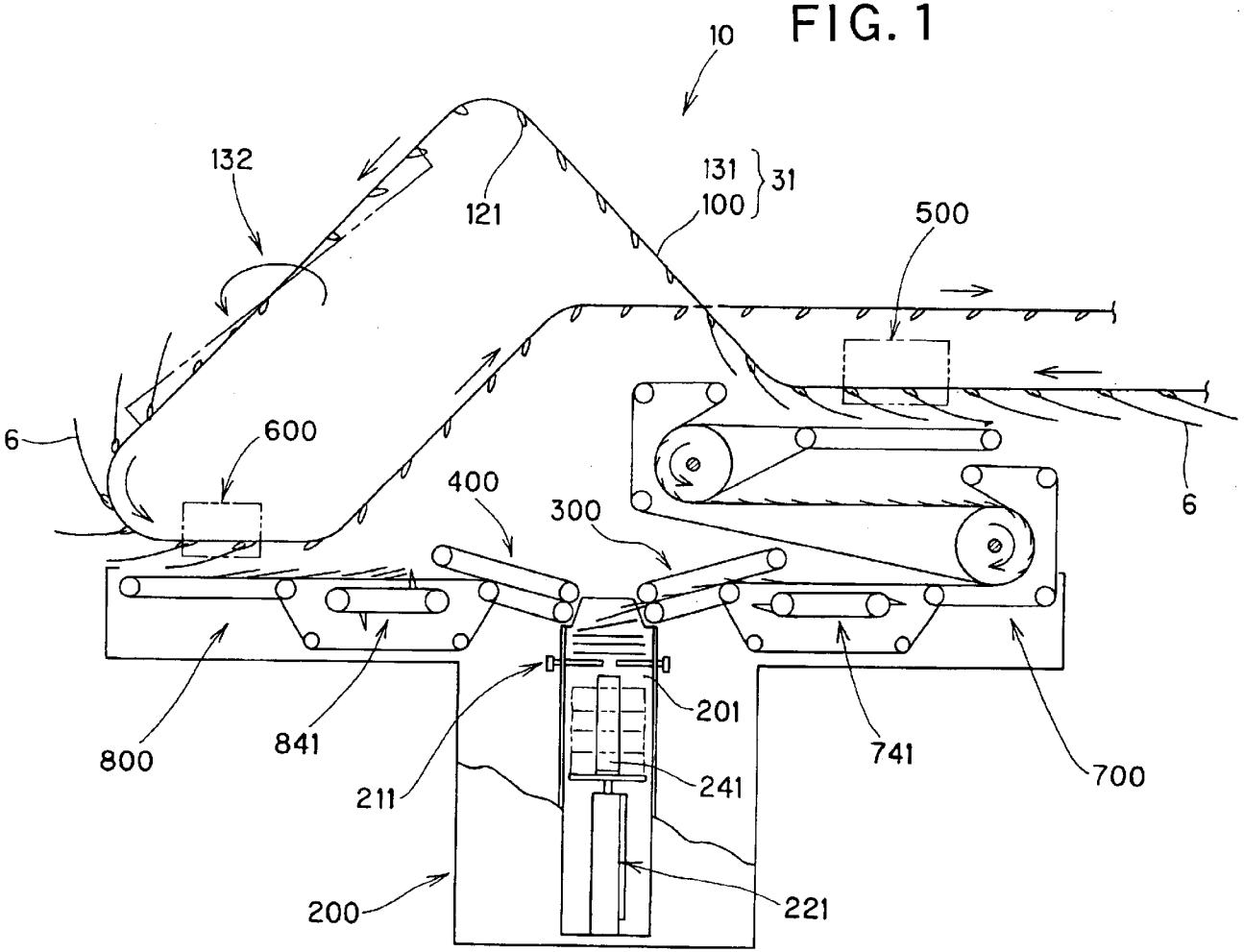
FIG. 1 is a configurational view of a signature-stacking apparatus according to an embodiment of the present invention.
Figure 2:
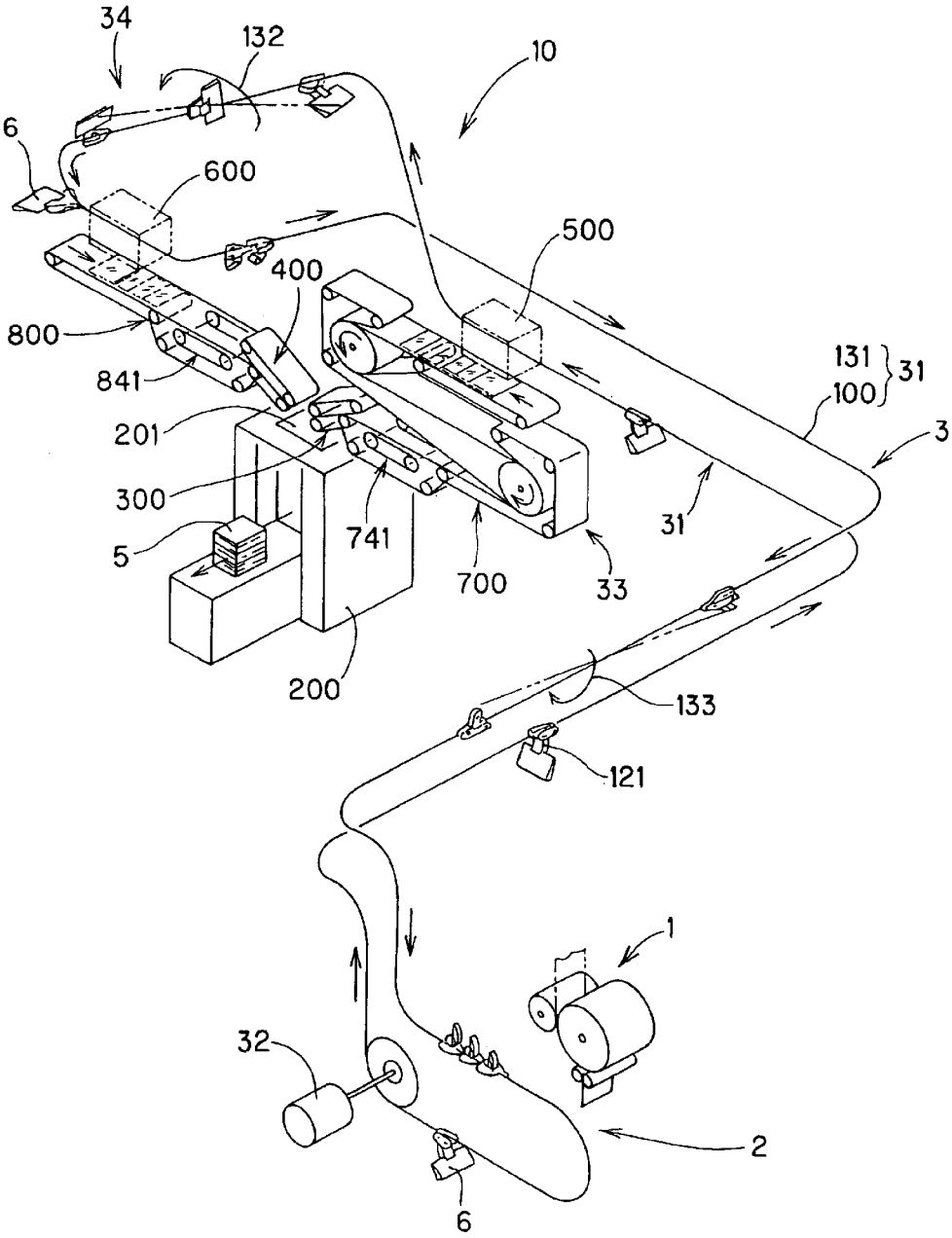
FIG. 2 is a perspective, configurational view showing a signature conveyance path and the signature-stacking apparatus of the embodiment.

Embodiments of the present invention will next be described in detail with reference to the drawings. As shown in FIGS. 1 and 2, a signature-stacking apparatus 10 according to an embodiment of the present invention includes:

(1) a conveyance path 31, which is defined by a conveyor chain 100 having a plurality of gripping mechanisms 121 for gripping and conveying corresponding signatures 6, and a guide member 131 for guiding the conveyor chain 100;

(2) a stacking section 200 for stacking the signatures 6 under the conveyance path 31;

(3) a first signature delivery section 300 and a second signature delivery section 400 provided on opposite sides of an opening portion of a stacking space 201 of the stacking section 200 and adapted to deliver the signatures 6 into the stacking space 201 by means of falling;

(4) a first signature release section 500 and a second signature release section 600 provided in the conveyance path 31, the first signature release section 500 corresponding to the first signature delivery section 300 and adapted to release the signatures 6 from the corresponding gripping mechanisms 121, and the second signature release section 600 corresponding to the second signature delivery section 400 and adapted to release the signatures 6 from the corresponding gripping mechanisms 121;

(5) a first conveyor mechanism 700 disposed between the first signature delivery section 300 and a position located under the first signature release section 500, and adapted to convey the signatures 6 released at the first signature release section 500 to the first signature delivery section 300; and (6) a second conveyor mechanism 800 disposed between the second signature delivery section 400 and a position located under the second signature release section 600, and adapted to convey the signatures 6 released at the second signature release section 600 to the second signature delivery section 400.

Figure 14:
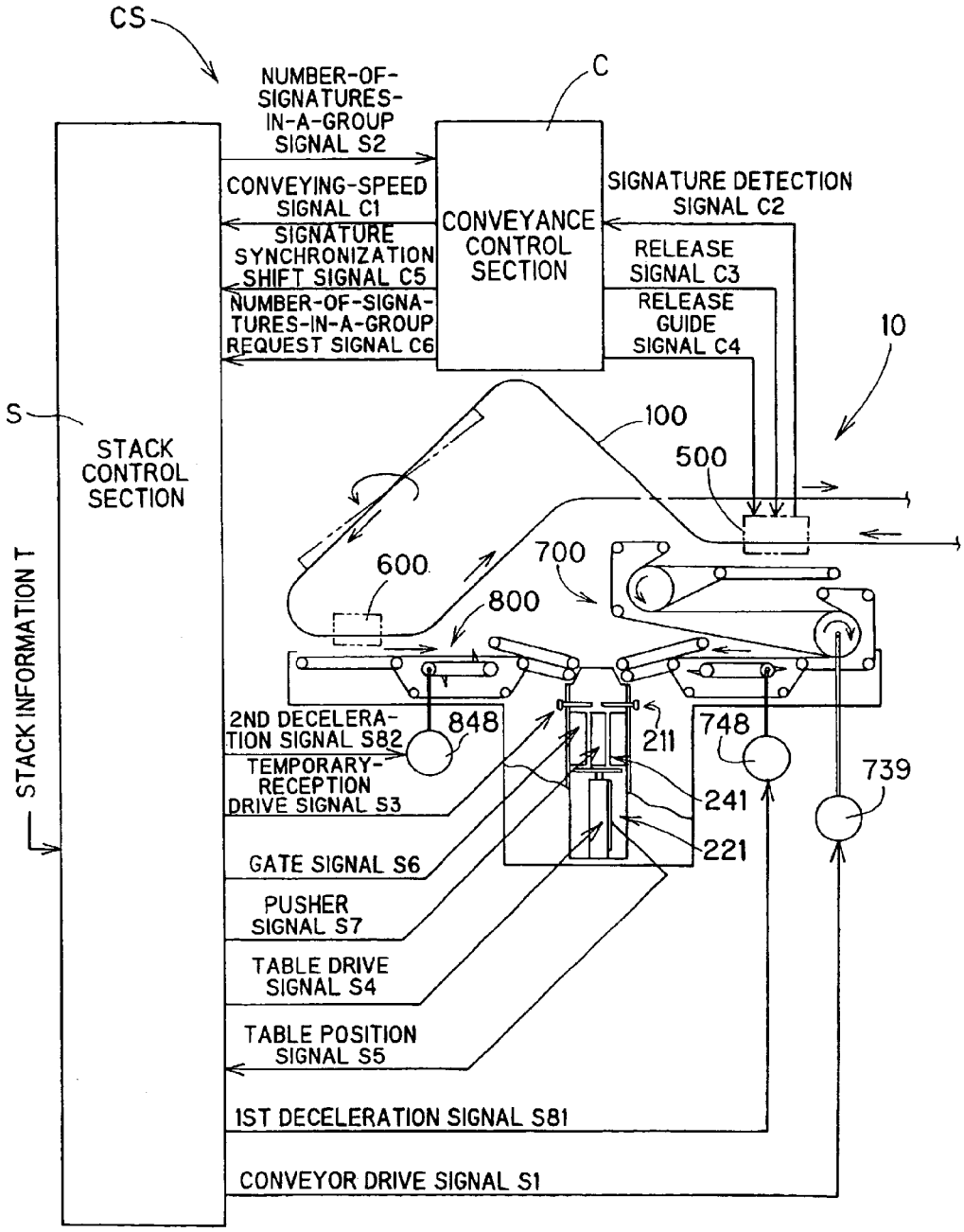
FIG. 14 is a control system diagram of the signature-stacking apparatus shown in FIG. 1.

As shown in FIG. 14, the signature-stacking apparatus 10 is controlled by control means CS composed of a conveyance control section C and a stacking control section S.

Structural features of the signature-stacking apparatus 10 will next be described.

As shown in FIG. 2, a travel path 3 of the conveyor chain 100 is a circulating path composed of a first half path and a second half path. The first half path extends from a signature-gripping station 2 of a folding unit 1 to the second signature release section 600 via the first signature release section 500. The second half path extends from the second signature release section 600 to the signature-gripping station 2. The guide member 131 allows a circulating operation of the conveyor chain 100.

The conveyance path 31 is arranged such that the gripper mechanisms 121 travel in opposite directions at at least the first signature release section 500 and the second signature release section 600; i.e., such that the traveling direction coincides with the direction of conveyance of the first conveyor mechanism 700 and with the direction of conveyance of the second conveyor mechanism 800, the first and second conveyor mechanisms 700 and 800 conveying the signatures 6 in mutually opposite directions.

As shown in FIG. 2, a drive unit 32 is provided at an appropriate position of the travel path 3 in the vicinity of the folding unit 1 in order to circulate the conveyor chain 100. The drive unit 32 is composed of, for example, a motor having an encoder, and a sprocket, which is driven by the motor.

Figure 16:
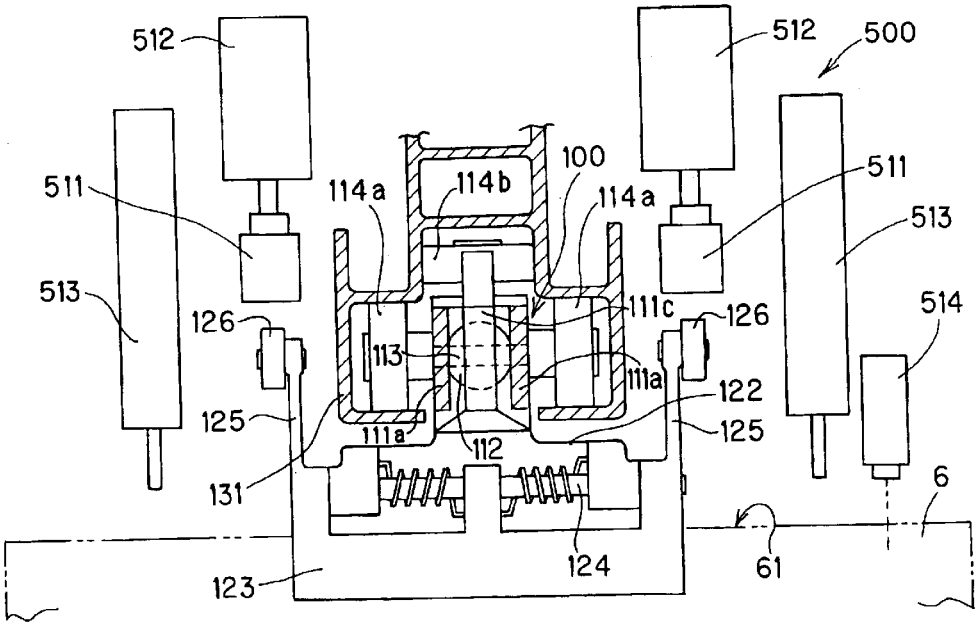
FIG. 16 is a sectional view of the conveyor chain as viewed in the direction of arrow C—C of FIG. 15, showing arrangement of components of the first signature release section in relation to the conveyor chain.

As shown in FIGS. 1 and 2, the guide member 131 is fixed along the travel path 3 to equipment frame (not shown) by use of appropriate mounting means. As shown in FIG. 16, the guide member 131 has an inverse-T-shaped cross section. As seen in the inverse-T-shaped cross section of FIG. 16, in an upper projection portion of the guide member 131, a horizontal partition wall is provided so as to serve as a reinforcement; in the internal space of the guide member 131, chain links 111 of the conveyor chain 100, which will be described later, are accommodated; and an opening portion is formed at the bottom of the guide member 131 so as to allow travel of the gripping mechanisms 121 attached to the corresponding chain links 111.

The conveyance path 31 is gradually twisted by 180 degrees (clockwise as viewed in the direction of travel in FIG. 2) in a predetermined region located between the first signature release section 500 and the second signature release section 600, thereby forming a twisted section 132. In a predetermined region of the second half of the conveyance path 31, the conveyance path 31 is gradually twisted by 180 degrees (counterclockwise as viewed in the direction of travel in FIG. 2) in a direction opposite that of the twist in the first half of the conveyance path 31, thereby forming a reverse twisted section 133.

In order for the conveyor chain 100 to travel while coinciding in direction of conveyance with the first and second conveyor mechanisms 700 and 800, which convey the signatures 6 in mutually opposite directions, the conveyor chain 100 must make a U-turn in a region between the first signature release section 500 and the second signature release section 600.

Even though the conveyor chain 100 has bearings (hereinafter referred to as "spherical bearings") 112 whose guide surfaces are spherical as will be described later, curving the conveyor chain 100 about an axis in parallel with a connection pin 113 (which will be described later) is far easier than curving the conveyor chain 100 about an axis perpendicular to the connection pin 113. Thus, it is advantageous for the conveyor chain 100 to make a U-turn on a vertical plane. Therefore, employment of the twisted section 132 and the reverse twisted section 133 is required.

When the vertical space is limited in relation to installation of the signature-stacking apparatus 10, the conveyor chain 100 must make a U-turn on a substantially horizontal plane. In this case, the twisted section 132 and the reverse twisted section 133 become unnecessary.

Figure 15:
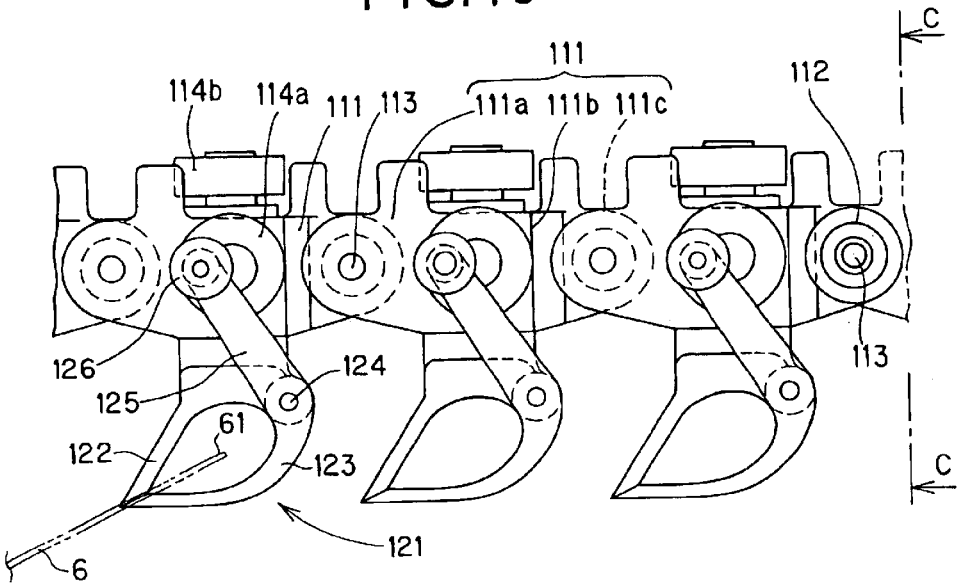
FIG. 15 is a partial, configurational view showing a conveyor chain.

As shown in FIG. 2, the conveyor chain 100 includes a large number of chain links 111, which are connected endlessly. As shown in FIGS. 15 and 16, each of the chain links 111 is a block composed of a first end portion 111*a*, an intermediate portion 111*b*, and a second end portion 111*c*, which are arranged along the direction of travel; i.e., along the longitudinal direction (in the right-and-left direction in FIG. 15). The first end portion 111*a* assumes a fork-like shape.

Specifically, the first end portion 111*a* is composed of a central groove portion having an appropriate width (in the direction perpendicular to paper on which FIG. 15 appears) and extending longitudinally, and two parallel leg portions located on corresponding opposite sides (in the direction perpendicular to paper on which FIG. 15 appears) of the central groove portion. The second end portion 111*c* is a narrow leg portion located at a position corresponding to the central groove portion of the first end portion 111*a*. The width of the second end portion 111*c* is such that, when the second end portion 111*c* is fitted into the central groove portion of the first end portion 111*a* of the adjacent chain link 111, a clearance is left on opposite sides of the second end portion 111*c* so as to allow a twisting movement.

A pin hole extends through the two leg portions (in the direction perpendicular to paper on which FIG. 15 appears, or in the right-and-left direction in FIG. 16) of the first end portion 111*a* of the chain link 111. A spherical hole extends through the second end portion 111*c* (in the direction perpendicular to paper on which FIG. 15 appears, or in the right-and-left direction in FIG. 16). A spherical, rotary member 112 having a pin hole is fitted into the spherical hole of the second end portion 111*c*, whereby the internal spherical surface of the spherical hole and the spherical, rotary member 112 constitute a spherical bearing.

The second end portion 111*c* is fitted into the central groove portion of the first end portion 111*a* of the adjacent chain link 111. Then, the connection pin 113 is inserted into the pin holes of the two leg portions of the first end portion 111*a* and into the pin hole of the spherical, rotary member 112 fitted into the second end portion 111*c*, whereby one chain link 111 and the adjacent chain link 111 are linked together. In other words, one chain link 111 and the adjacent chain link 111 are linked together via the spherical bearing.

Thus, the chain links 111 are linked endlessly in such a manner as to be pivotable about the axes of the connection pins 113 and twistable about the direction of travel, thereby forming the conveyor chain 1.

As shown in FIGS. 15 and 16, in each of the chain links 111, the gripping mechanism 121 is provided on one of longitudinally extending side surfaces of the intermediate portion 111*b* parallel to the connection pin 113 (a lower portion of the intermediate portion 111*b* in FIG. 15) in such a manner as to project downward.

In each of the chain links 111, projections project upward (see FIG. 15) from corresponding upper portions of the two leg portions of the first end portion 111*a*, and a projection projects upward from an upper portion of the second end portion 111*c*. These projections are engaged with driving projections (e.g., a rotatably driven sprocket) of the drive unit 32.

Each of the gripping mechanisms 121 projects downward (in FIGS. 15 and 16) from the intermediate portion 111*b* of the corresponding chain links 111 and extends laterally (in the right-and-left direction in FIG. 16). The gripping mechanism 121 includes a stationary gripping member 122, a pin 124, a movable gripping member 123, a pair of torsion coil springs, and a pair of arms 125. A lower end portion of the stationary gripping member 122 is formed into a gripping claw. The pin 124 is rotatably supported by an intermediate forked portion of the stationary gripping member 122. Opposite end projections and a central projection of the movable gripping member 123 are attached to the pin 124, and the distal end of the movable gripping member 123 is formed into a gripping claw whose width is equal to that of the gripping claw of the stationary gripping member 122. The paired torsion coil springs are wound onto the pin 124 such that end portions of each torsion coil spring are attached respectively to the intermediate forked portion of the stationary gripping member 122 and the central projection of the movable gripping member 123. The paired torsion coil springs cause the movable gripping member 123 to rotate about the pin 124 such that the gripping claw of the movable gripping member 123 is pressed against the gripping claw of the stationary gripping member 122. The paired arms 125 are formed integrally with the movable gripping member 123 at the corresponding opposite sides of the movable gripping member 123. A cam follower 126 is provided at an end of each of the paired arms 125.

A force of the paired torsion coil springs causes the movable gripping member 123 to rotate such that the gripping claw of the movable gripping member 123 is pressed against the gripping claw of the stationary gripping member 122, whereby the signature 6 can be gripped therebetween. The cam followers 126 provided at the corresponding ends of the paired arms 125 are pressed externally to thereby cause the paired arms 125; i.e., the movable gripping member 123, to be angularly displaced against the force of the paired torsion coil springs. As a result, the gripping claw of the movable gripping member 123 moves away from the gripping claw of the stationary gripping member 122.

A first roller shaft projects laterally (in the right-and-left direction in FIG. 16) outward from each of opposite sides of the intermediate portion 111*b* of each of the chain links 111. A second roller shaft projects upward from an upper portion of the intermediate portion 111*b*. A first roller 114*a* is rotatably attached to a distal end portion of each of the two first roller shafts. A second roller 114*b* is rotatably attached to a distal end portion of the second roller shaft.

As viewed in the inverse-T-shaped cross section of the guide member 131 in FIG. 16, the first rollers 114*a* and the second roller 114*b* are provided in the guide member 131 as follows: the first rollers 114*a* are located in a lower space of the inverse-T-shaped cross section and can roll on the corresponding inner surfaces of opposite bottom portions of the guide member 131; and the second roller 114*b* is located in an upper projection space of the inverse-T-shaped cross section and can roll on the inner surface of one side portion of an upper projection portion of the guide member 131. Thus, the conveyor chain 100 can circulate while being guided by the guide member 131.

As shown in FIGS. 3, 5, 6, and 16, the first signature release section 500 includes a pair of first release members 511, a pair of first drive members 512, a pair of first release guides 513, and a signature detector 514. When each of the gripping mechanisms 121 approaches the paired first release members 511 in association with travel of the conveyor chain 100 while gripping the signature 6, the paired first release members 511 press down the corresponding cam followers 126 of the movable gripping member 123 of the gripping mechanism 121. The paired first drive members 512 (e.g., first drive pneumatic cylinders) actuate the corresponding first release members 511. The paired first release guides 513 (e.g., first guide pneumatic cylinders) guide the signature 6 released from the gripping mechanism 121 so that the signature 6 falls at a regular position. The signature detector 514 detects the approaching signature 6 gripped by the gripping mechanism 121. These members are attached to unillustrated support members.

The paired first release members 511 are attached to the corresponding first drive members 512 (e.g., to the corresponding ends of piston rods of the first drive pneumatic cylinders), which are provided on corresponding opposite sides of the guide member 131 at lateral positions (positions in the width direction of the signature 6) that face the cam followers 126 of each of the gripping mechanisms 121 traveling underneath.

The paired first release guides 513 are provided such that the traveling gripping mechanisms 121 pass therebetween and such that their guide surfaces are inclined downward in the direction of travel of the gripping mechanisms 121, at two lateral positions corresponding to opposite near-side-edge portions of the signature 6. The paired first release guides 513 are, for example, the piston rods of the paired first guide pneumatic cylinders. The piston rods are inclined such that their distal ends face downstream in relation to the direction of travel of the gripping mechanisms 121. When the first signature release section 500 is activated, the paired piston rods are extended trough activation of the paired first guide pneumatic cylinders. The extended piston rods guide a leading end portion 61 (crease) of the signature 6 released from the gripping mechanism 121, by means of their outer circumferential surfaces, so as to cause the signature 6 to fall on a first signature reception section 712 at a regular position.

As shown in FIG. 2, for the sake of convenience, the path of conveyance of the signatures 6 that extends from the first signature release section 500 to the end of the first signature delivery section 300 is taken as a first conveyance path 33; and the path of conveyance of the signatures 6 that extends from the first signature release section 500 to the end of the second signature delivery section 400 via the second signature release section 600 is taken as a second conveyance path 34.

On the basis of a signature detection signal C2 issued from the signature detector 514 and a number-of-signatures-in-a-group signal S2, the control means CS (see FIG. 14), which contains previously set stack information T, determines timing of opening the gripping mechanisms 121 in order to deliver a predetermined number of signatures 6 alternately to the first conveyance path 33 and the second conveyance path 34. The control means CS activates the first signature release section 500 in accordance with the determined timing.

Figure 4:
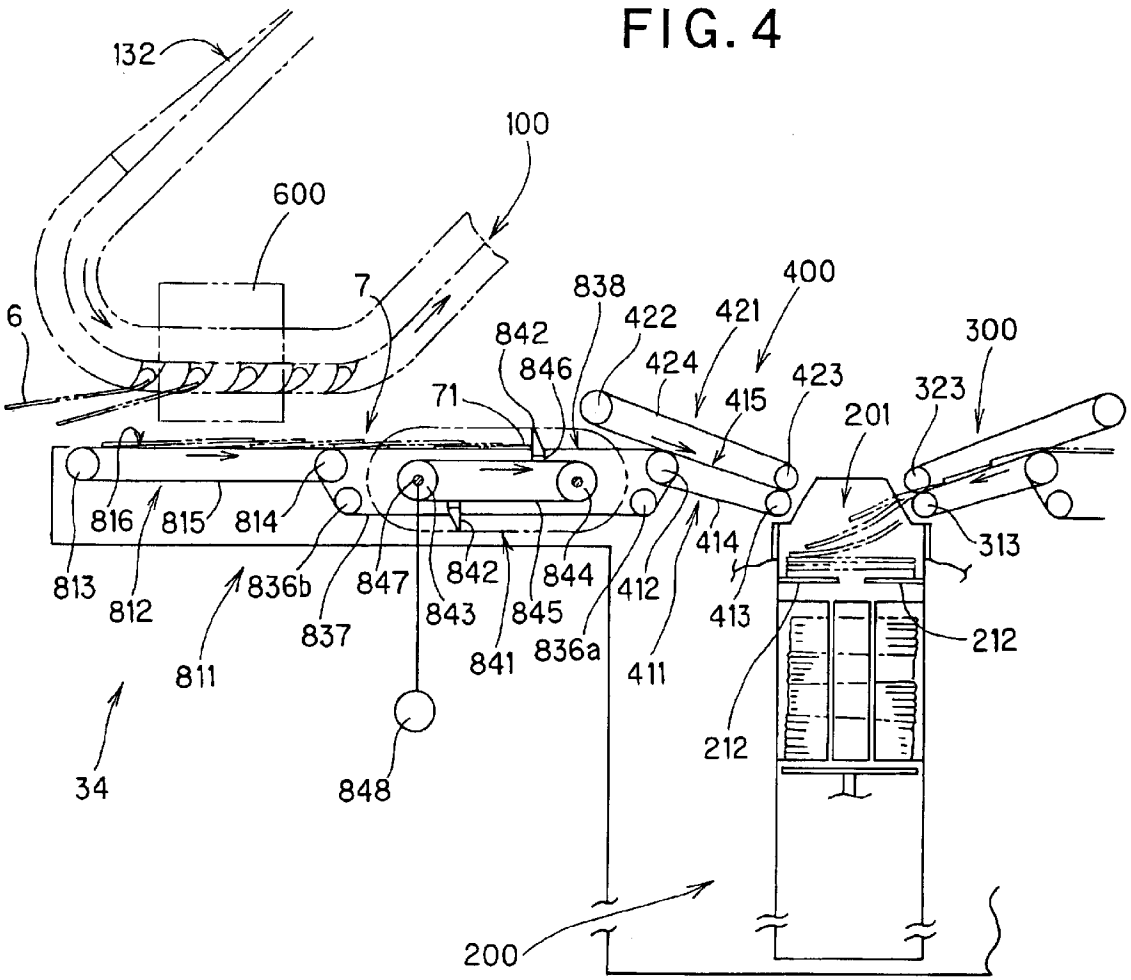
FIG. 4 is a front view showing a second conveyor mechanism and its peripheral region in the signature-stacking apparatus shown in FIG. 1.
Figure 7:
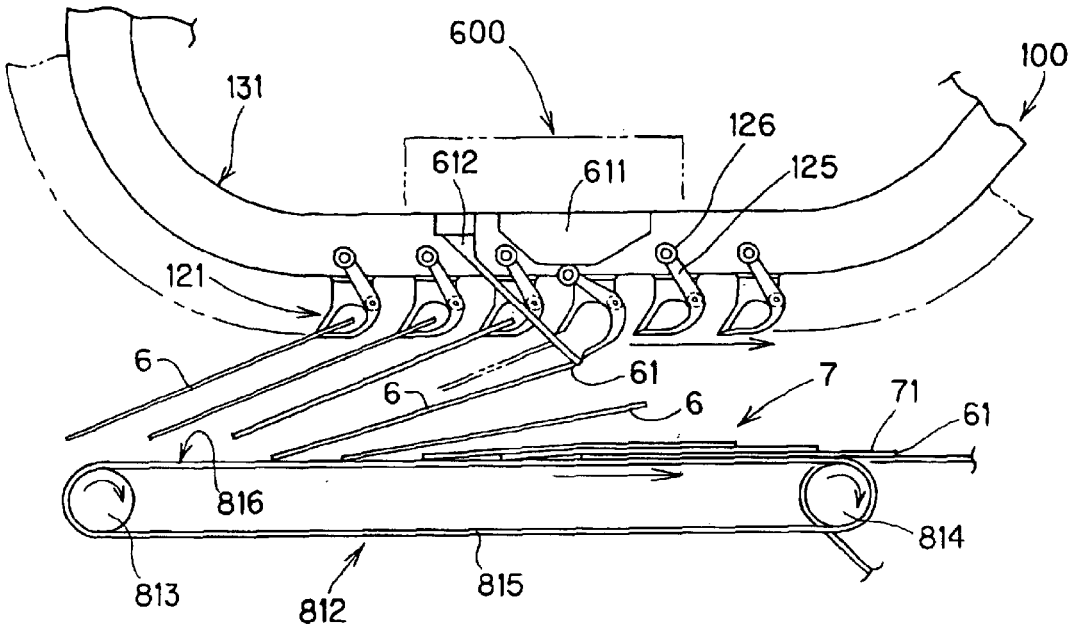
FIG. 7 is a partially enlarged view showing a second signature release section and a second signature reception section, whose release of signatures is activated at all times.
Figure 17:
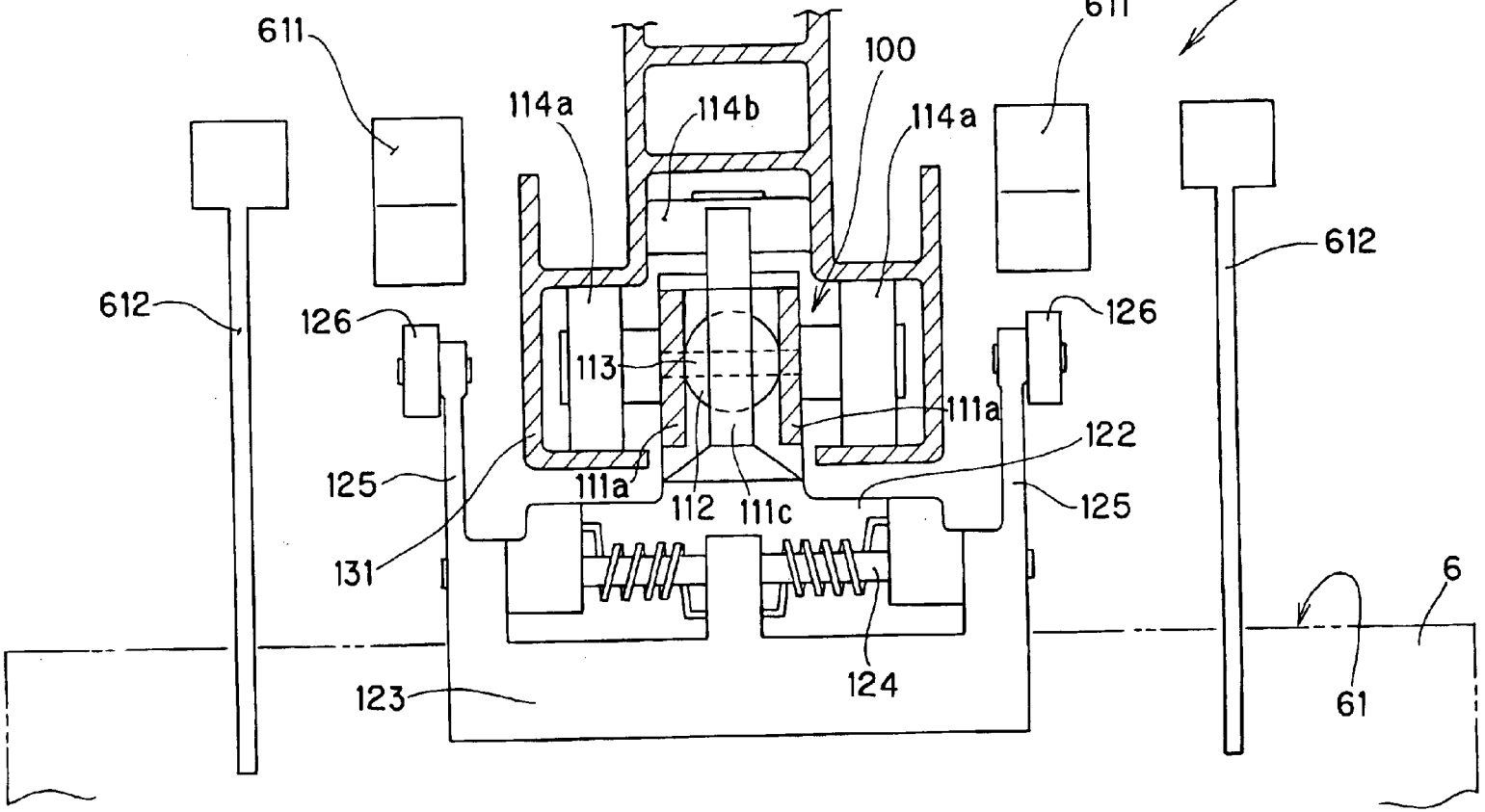
FIG. 17 is a sectional view of the conveyor chain as viewed in the direction of arrow C—C of FIG. 15, showing arrangement of components of the second signature release section in relation to the conveyor chain.

As shown in FIGS. 4, 7, and 17, the second signature release section 600 includes a pair of second release members 611 and a pair of second release guides 612. When each of the gripping mechanisms 121 passes the second signature release section 600 in association with travel of the conveyor chain 100, the paired second release members 611 cause the movable gripping member 123 of the gripping mechanism 121 to open. The paired second release guides 612 guide the signature 6 released from the gripping mechanism 121 so that the signature 6 falls at a regular position. These members are attached to unillustrated support members.

The second release members 611 are fixedly provided on corresponding opposite sides of the guide member 131 at lateral positions (positions in the width direction of the signature 6) that face the cam followers 126 of the arms 125 provided at opposite sides of the movable gripping member 123 of each of the gripping mechanisms 121 traveling underneath. When, in association with travel of the conveyor chain 100, the paired cam followers 126 of the movable gripping member 123 of the gripping mechanism 121 pass under the corresponding second release members 611, the second release members 611 cause the corresponding cam followers 126 to be pressed downward. The second release members 611 cause every movable gripping member 123 to be opened, regardless of whether or not the signature 6 is gripped.

As in the case of the arrangement of the paired first release guides 513, the paired second release guides 612 are provided such that the traveling gripping mechanisms 121 pass therebetween and such that their guide surfaces are inclined downward in the direction of travel of the gripping mechanisms 121, at two lateral positions corresponding to opposite near-side-edge portions of the signature 6. The paired second release guides 612 guide the leading end portion 61 (crease) of the signature 6 released from the gripping mechanism 121, by means of their inclined surfaces, so as to cause the signature 6 to fall on a second signature reception section 812 at a regular position.

Figure 3:
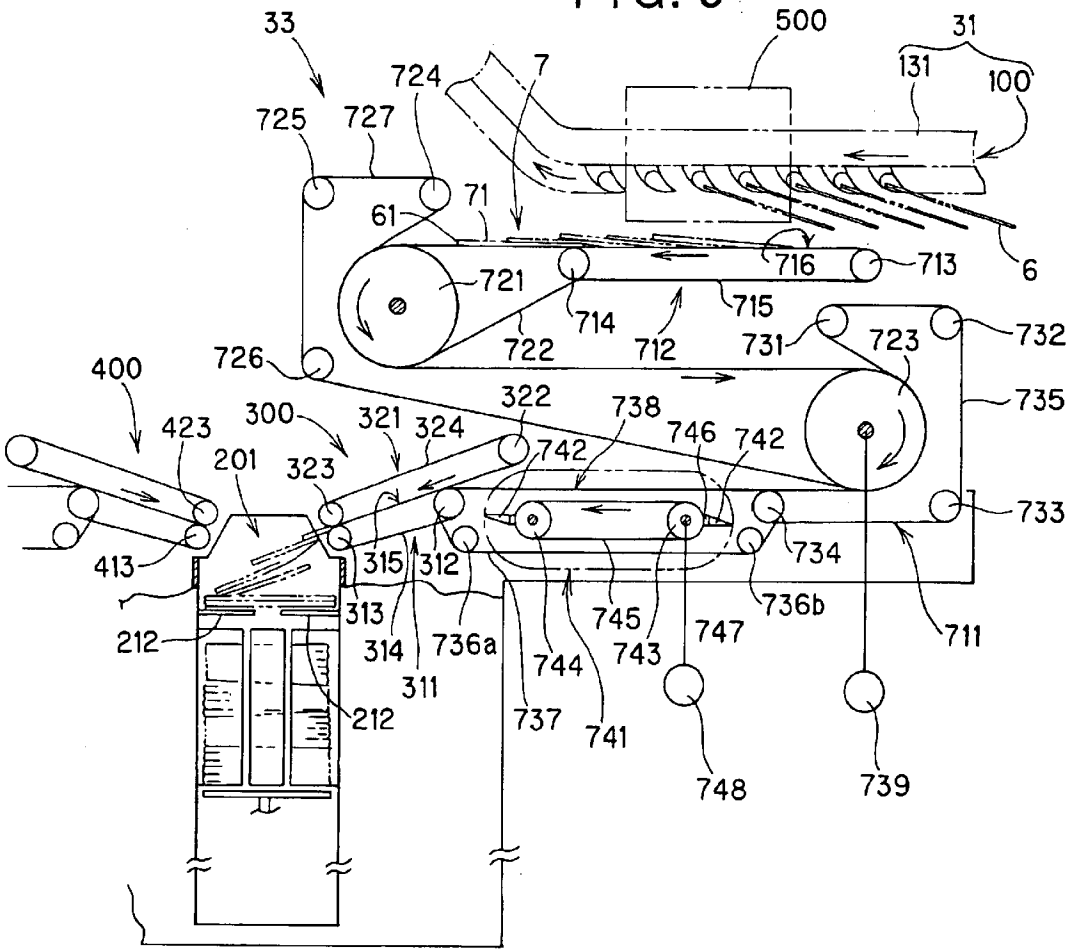
FIG. 3 is a front view showing a first conveyor mechanism and its peripheral region in the signature-stacking apparatus shown in FIG. 1.

As mentioned previously, the direction of conveyance of the first conveyor mechanism 700 coincides with that of the conveyance path 31 in the first signature release section 500. As shown in FIGS. 1 to 3, the first conveyor mechanism 700 includes a first conveyor 711 and a first deceleration mechanism 741. The first conveyor 711 includes the first signature reception section 712, and the first deceleration mechanism 741 is a first braking mechanism. The first conveyor 711 can travel at a speed substantially equal to the traveling speed of the conveyor chain 100 and thus can travel synchronously with the conveyor chain 100. The first deceleration mechanism 741 is designed to be activated at appropriate timing, run at a speed lower than the traveling speed of the first conveyor 711, and then stop.

The first conveyor 711 includes an endless conveyor belt 715, which serves as the first signature reception section 712; subsequent endless conveyor belts 722, 727, 735, and 737; and a group or rollers which the conveyor belts are looped around and mounted on.

The endless conveyor belt 715 is looped around and mounted on an upstream roller 713 and a downstream roller 714, which are arranged horizontally with a certain distance therebetween. A conveyor surface 716, which is the upper surface of the loop of the endless conveyor belt 715, serves as the first signature reception section 712, whose upstream portion faces the first signature release section 500 located above with an appropriate distance therebetween. The endless conveyor 715 successively receives the signatures 6 that are released from the corresponding gripping mechanisms 121 while being guided by the paired first release guides 513, and conveys the signatures 6 in an overlapping condition.

The endless conveyor belt 722 subsequent to the endless conveyor belt 715 is looped around and mounted on the roller 714 and a downstream large-diameter roller 721. The endless conveyor belts 715 and 722 share the roller 714. The subsequent endless conveyor belt 727 is looped around and mounted on appropriately arranged rollers 724, 725, and 726 and a downstream large-diameter roller 723 located under the endless conveyor belt 715. On the large-diameter roller 721, the endless conveyor belt 727 overlies the endless conveyor belt 722 over substantially half of the circumference of the large-diameter roller 721.

The further downstream endless conveyor belt 735 is looped around and mounted on appropriately arranged rollers 731, 732, 733, and 734. The furthest downstream roller 734 is located under the endless belt conveyor 727. On the large-diameter roller 723, the endless conveyor belt 735 overlies the endless conveyor belt 727 over substantially half of the circumference of the large-diameter roller 723.

The furthest downstream endless conveyor belt 737 located under the endless conveyor belt 727 is looped around and mounted on the roller 734 and appropriately arranged rollers 736*a*, 736*b*, and 312. The endless conveyor belts 735 and 737 share the roller 734. The upper surface of the loop of the endless conveyor belt 737 serves as a conveyance surface 738, which opens upward.

A drive unit 739 (e.g., a servomotor having an encoder) is provided on the large-diameter roller 723 of the first conveyor 711. The drive unit 739 drives the first conveyor 711, the first signature delivery section 300, a second conveyor 811 to be described later, and the second signature delivery section 400 to be described later, by means of unillustrated drive systems. The servomotor is designed such that the conveyor chain 100 and the first conveyor 711 travel at substantially the same speed.

Figure 8:
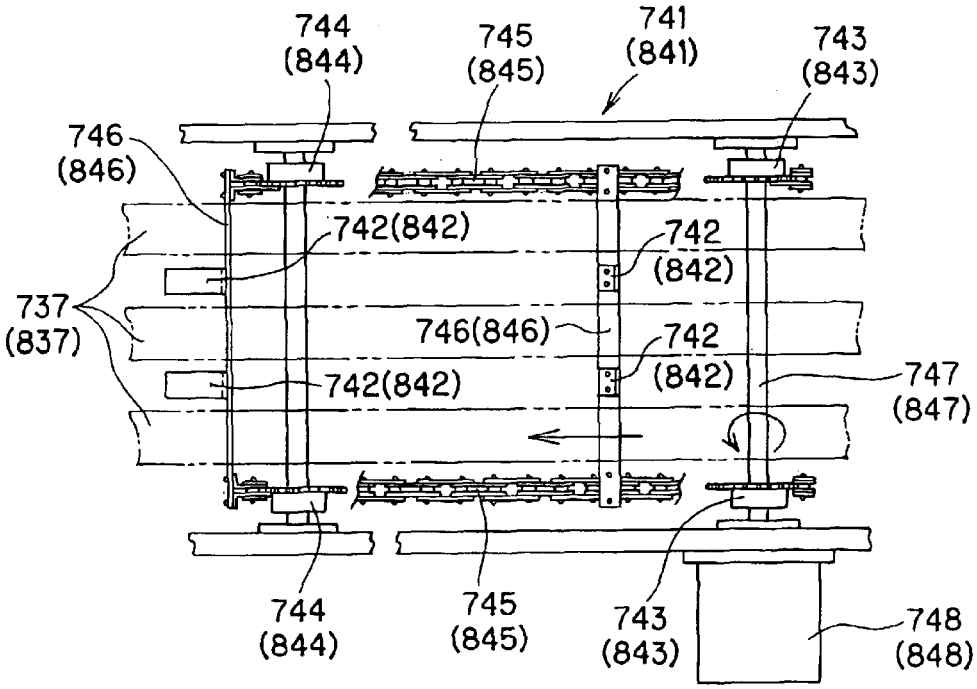
FIG. 8 is a plan view showing a first deceleration mechanism incorporated in the first conveyor mechanism.

As shown in FIGS. 3 and 8, the first deceleration mechanism 741 is provided between the roller 312 (an upstream roller of the first signature delivery section 300, which will be described later) and the furthest downstream roller 734 of the first conveyor 711. The first deceleration mechanism 741 is configured in such a manner as to hide under the conveyance surface 738. Two endless chains 745 are looped around and mounted in parallel with each other on corresponding pairs of sprockets 743 and 744 (only one pair of sprockets 743 and 744 appears in FIG. 3), which are provided along the direction of conveyance with an appropriate distance therebetween.

Two connection bars 746 extend between the two chains 745 and connect the two chains 745 at two corresponding positions that are located in such a manner as to halve the length of the loop of each of the chains 745. Two projections 742 each having an appropriate length are provided on each of the bars 746 in such a manner as to be projectable from the conveyance surface 738. A drive unit 748 (e.g., a servomotor having an encoder) is provided on a sprocket shaft 747 of one of the two sprockets 743 and is adapted to move or stop the projections 742.

In the first conveyor 711, the position of a first signature 71 in a row-of-signatures 7 conveyed in an overlapping condition is tracked by means of a signature synchronization shift signal C5 (see FIG. 14), which is output from the conveyance control section C on the basis of an unillustrated encoder signal, which in turn is output from the drive unit 32 (see FIG. 2) of the conveyor chain 100, with the first signature release section 500 serving as a starting point.

Figure 9A:
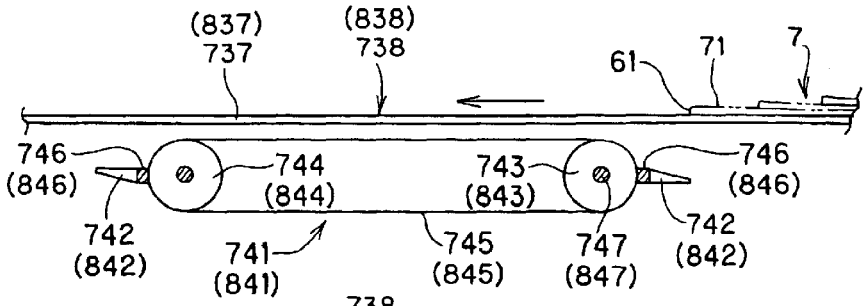
FIGS. 9A to 9E are explanatory views for explaining operation of the first deceleration mechanism of FIG. 8.
Figure 9B:
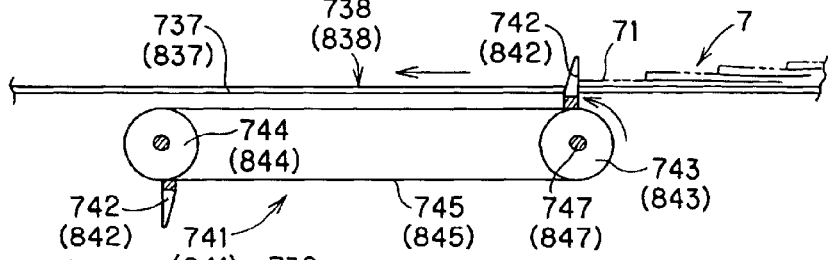
Figure 9C:
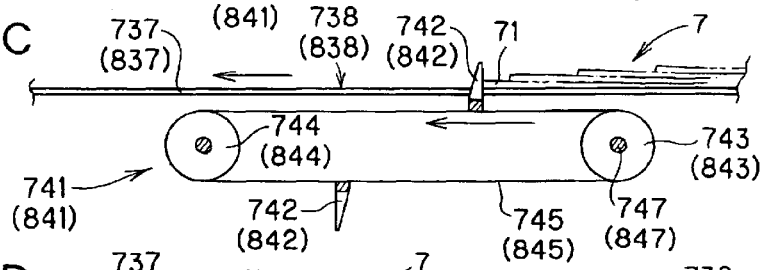
Figure 9D:
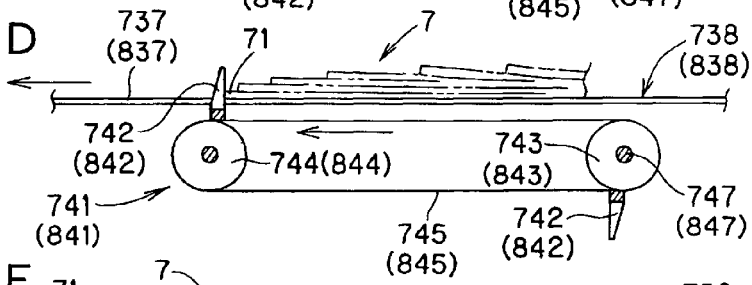

When the leading end portion 61 of the first signature 71 reaches an appropriate position located near the two projections 742 that hide and stand by under the conveyance surface 738 as shown in FIG. 9A, the first deceleration mechanism 741 operates as follows. The drive unit 748 shown in FIG. 8 rotates the sprocket shaft 747 by an appropriate amount such that the two projections 742 project upright from the conveyance surface 738 (see FIG. 9B). Then, the two upright projections 742 move together with the first signature 71 while leading the subsequent signatures 6 (see FIGS. 9C and 9D).

Figure 9E:
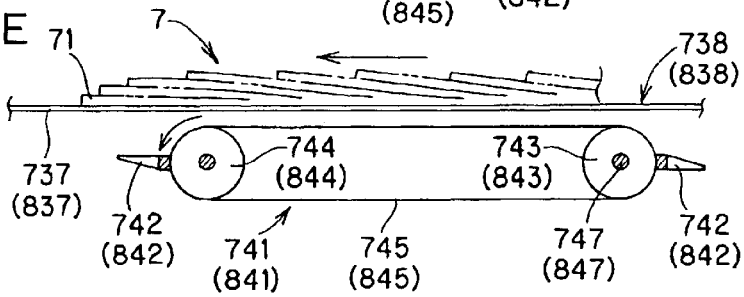

When the two upright projections 742 move by half of the loop length of the chain 745, the two projections 742 hide under the conveyance surface 738 and stand by (see FIG. 9E). The moving speed of the two projections 742 projecting from the conveyance surface 738 is reduced at an appropriate rate in relation to the speed of conveyance of the first conveyor 711.

Figure 10A:
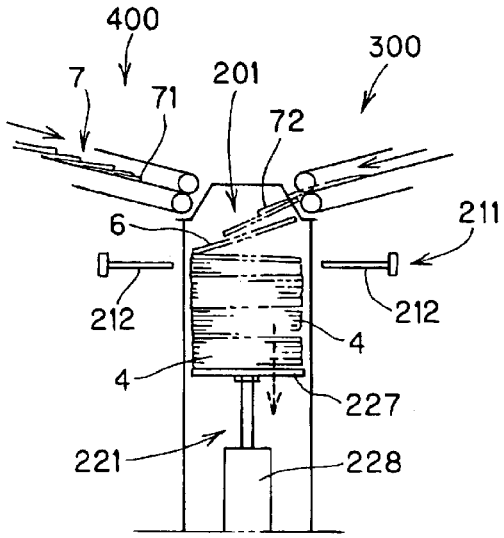
FIGS. 10A to 10D are explanatory views for explaining stacking and unloading in a stacking section, where

The leading end portion 61 of the first signature 71, which leads subsequent signatures 6 conveyed in an overlapping condition on the first conveyor 711, is caused to bump against the two projections 742, which are moving at a speed lower than the speed of conveyance of the first conveyor 711. Thus, the first signature 71 is caused to travel while being temporarily decelerated. A plurality of signatures 6 that occupy a leading portion of the row-of-signatures 7 are braked, so that their overlapping pitch is gradually decreased. This delays timing of delivering the first signature 71 of the row-of-signatures 7 into the stacking space 201, thereby lengthening the interval between the first signature 71 and a last signature 72 of the row-of-signatures 7 that has been delivered into the stacking space 201 after being conveyed along the second conveyance path 34 (see FIGS. 10A and 10B).

A stopper mechanism, which is an unillustrated, other embodiment of the first braking mechanism and is adapted to stop conveyance of the signatures 6, will next be described with reference to FIG. 3.

A first stopper mechanism, which serves as the first braking mechanism, replaces the first deceleration mechanism 741 and is provided above the conveyance surface 738. The first stopper mechanism is configured as follows. At least a single pneumatic cylinder is provided, and a plate-like member, which corresponds to the projection 742, is attached to a rod end portion of the pneumatic cylinder in such a manner as to lie perpendicular to the direction of conveyance; i.e., such that the edge of the plate-like member becomes parallel with the crease of the leading end portion 61 of the signature 6. When the pneumatic cylinder is activated, the plate-like member lowers toward the conveyance surface 738, thereby obstructing movement of the first signature 71 of a row of signatures 6 conveyed on the conveyance surface 738. Thus, the row of signatures 6 is braked so as not to move on the conveyance surface 738.

As in the case of the above-described first braking mechanism, a second braking mechanism to be described later can similarly assume the form of a second stopper mechanism. Thus, description of the second stopper mechanism is omitted.

Needless to say, either the first deceleration mechanism or the first stopper mechanism can be combined with either the second deceleration mechanism or the second stopper mechanism.

As mentioned previously, the direction of conveyance of the second conveyor mechanism 800 coincides with that of the conveyance path 31 in the second signature release section 600. The second conveyor mechanism 800 is disposed in opposition to the first conveyor mechanism 700 such that its direction of conveyance becomes opposite the direction of conveyance of the first conveyor mechanism 700. As shown in FIGS. 1, 2, and 4, the second conveyor mechanism 800 includes a second conveyor 811 and a second deceleration mechanism 841. The second conveyor 811 includes the second signature reception section 812; and the second deceleration mechanism 841 is a second braking mechanism.

The second conveyor 811 can travel at a speed substantially equal to the traveling speed of the conveyor chain 100 and thus can travel synchronously with the conveyor chain 100. The second deceleration mechanism 841 is designed to be activated at appropriate timing, run at a speed lower than the traveling speed of the second conveyor 811, and then stop. The second conveyor 811 includes an endless conveyor belt 815, which serves as the second signature reception section 812; an endless conveyor belt 837; and a group of rollers which the conveyor belts are looped around and mounted on.

The endless conveyor belt 815 is looped around and mounted on an upstream roller 813 and a downstream roller 814, which are arranged horizontally with a certain distance therebetween. A conveyor surface 816, which is the upper surface of the loop of the endless conveyor belt 815, serves as the second signature reception section 812, whose upstream portion faces the second signature release section 600 located above with an appropriate distance therebetween. The endless conveyor 815 successively receives the signatures 6 that are released from the corresponding gripping mechanisms 121 while being guided by the paired second release guides 612, and conveys the signatures 6 in an overlapping condition.

The endless conveyor belt 837 subsequent to the endless conveyor belt 815 is looped around and mounted on the roller 814 and appropriately arranged downstream rollers 412, 836*a*, and 836*b*. The endless conveyor belts 815 and 837 share the roller 814. The upper surface of the loop of the endless conveyor belt 837 serves as a conveyance surface 838, which opens upward.

As mentioned previously, the drive unit 739 (e.g., a servomotor having an encoder) provided on the first conveyor 711 drives the second conveyor 811 and the second signature release section 400 via unillustrated transmission means in an interlocking relation with the first conveyor 711.

As shown in FIG. 4 and represented by parenthesized reference numerals in FIGS. 8 and 9, the second deceleration mechanism 841 is configured similarly to the first deceleration mechanism 741. Specifically, the second deceleration mechanism 841 is provided between the roller 412 (an upstream roller of the second signature delivery section 400, which will be described later) and the furthest downstream roller 814 of the second conveyor 811. The second deceleration mechanism 841 is configured in such a manner as to hide under the conveyance surface 838. Two endless chains 845 are looped around and mounted in parallel with each other on corresponding pairs of sprockets 843 and 844 (only one pair of sprockets 843 and 844 appears in FIG. 4), which are provided along the direction of conveyance with an appropriate distance therebetween.

Two connection bars 846 extend between the two chains 845 and connect the two chains 845 at two corresponding positions that are located in such a manner as to halve the length of the loop of each of the chains 845. Two projections 842 each having an appropriate length are provided on each of the bars 846 in such a manner as to be projectable from the conveyance surface 838. A drive unit 848 (e.g., a servomotor having an encoder) is provided on a sprocket shaft 847 of one of the two sprockets 843 and is adapted to move or stop the projections 842.

As in the case of the first deceleration mechanism, in the second conveyor 811, the position of the first signature 71 in the row-of-signatures 7 conveyed in an overlapping condition is tracked by means of the signature synchronization shift signal C5 (see FIG. 14), which is output from the conveyance control section C on the basis of an unillustrated encoder signal, which in turn is output from the drive unit 32 (see FIG. 2) of the conveyor chain 100 with the first signature release section 500 serving as a starting point.

When the leading end portion 61 of the first signature 71 reaches an appropriate position located near the two projections 842 that hide and stand by under the conveyance surface 838, the second deceleration mechanism 841 operates as follows. The drive unit 848 shown in FIG. 8 rotates the sprocket shaft 847 by an appropriate amount such that the two projections 842 project upright from the conveyance surface 838. Then, the two upright projections 842 move together with the first signature 71 while leading the subsequent signatures 6.

When the two upright projections 842 move by half of the loop length of the chain 845, the two projections 842 hide under the conveyance surface 838 and stand by. The moving speed of the two projections 842 projecting from the conveyance surface 838 is reduced at an appropriate rate in relation to the speed of conveyance of the second conveyor 811.

The leading end portion 61 of the first signature 71, which leads subsequent signatures 6 conveyed in an overlapping condition on the second conveyor 811, is caused to bump against the two projections 842, which are moving at a speed lower than the speed of conveyance of the second conveyor 811. Thus, the first signature 71 is caused to travel while being temporarily decelerated. A plurality of signatures 6 that occupy a leading portion of the row-of-signatures 7 are braked, so that their overlapping pitch is gradually decreased. This delays timing of delivering the first signature 71 of the row-of-signatures 7 into the stacking space 201, thereby lengthening the interval between the first signature 71 and the last signature 72 of the row-of-signatures 7 that has been delivered into the stacking space 201 after being conveyed along the first conveyance path 33.

Next, after arrival at the first signature release section 500, the signatures 6 are conveyed along either the first conveyance path 33 or the second conveyance path 34. The length of the first conveyance path 33 and that of the second conveyance path 34 will next be described with reference to FIGS. 2 to 4.

The signatures 6 that arrive and are released at the first signature release section 500 are conveyed along the first conveyance path 33 up to downstream rollers 313 and 323 of the first signature release section.300. The signatures 6 that arrive at and pass the first signature release section 500 are conveyed along the second conveyance path 34; i.e., the signatures 6 are conveyed by means of the conveyor chain 100, are released at the second signature release section 600, and are conveyed up to downstream rollers 413 and 423 of the second signature delivery section 400. The length of the first conveyance path 33 and that of the second conveyance path 34 are rendered substantially equal. The speed of conveyance along the first conveyance path 33 and that along the second conveyance path 34 are rendered substantially equal. In other words, the signatures 6 are conveyed at the same speed along the first and second conveyance paths 33 and 34.

Therefore, in the case where the first deceleration mechanism 741 and the second deceleration mechanism 841 are deactivated, signatures are conveyed as described bellow. A row of signatures 6 is divided into the row-of-signatures 7 to be conveyed along the first conveyance path 33 and the row-of-signatures 7 to be conveyed along the second conveyance path 34. When the first signature 71 of the row-of-signatures 7 conveyed along the first conveyance path 33 and the last signature 72 of the row-of-signatures 7 conveyed along the second conveyance path 34 reach, respectively, the downstream rollers 313 and 323 of the first signature delivery section 300 and the downstream rollers 413 and 423 of the second signature delivery section 400 and are to be delivered into the stacking space 210, the leading end portion 61 of the first signature 71 of the row-of-signatures 7 conveyed along the first conveyance path 33 and the leading end portion 61 of the last signature 72 of the row-of-signatures 7 conveyed along the second conveyance path 34 have a positional relationship such that the delivery of the first signature 71 of the row-of-signatures 7 conveyed along the first conveyance path 33 is delayed from the delivery of the last signature 72 of the row-of-signatures 7 conveyed along the second conveyance path 34 by one overlapping pitch at which the signatures 6 are overlapped in the course of conveyance on, for example, the first conveyor 711.

Thus, the above-mentioned pitch is expanded by means of delaying conveyance of a leading portion of the row-of-signatures 7 conveyed on the first conveyor mechanism 700 or the second conveyor mechanism 800 through temporary activation of the first deceleration mechanism 741 or the second deceleration mechanism 841. In the case of the present embodiment, where the conveyor chain 100 and the two conveyor mechanisms 700 and 800 convey the signatures 6 at substantially the same speed of conveyance, the first conveyance path 33 and the second conveyance path 34, both of which start from the first signature release section 500, assume the same length.

In the case of another embodiment where the length of the first conveyance path 33 is shorter by $\alpha$ than the second conveyance path 34 to thereby render the first conveyor mechanism 700 compact, the speed of conveyance of the first conveyor 711 may be reduced to a degree corresponding to $\alpha$. Specifically, when the second conveyance path 34 has a length of L as measured from the position of release of the signature 6 in the first signature release section 500 and a speed of conveyance of V, the length of conveyance path associated with the first conveyor mechanism 700 is $L-\alpha$. Thus, the speed of conveyance of the first conveyor mechanism 700 is $(1-\alpha/L)\cdot V$. In other words, the speed of conveyance of the first conveyor mechanism 700 may be reduced by $\alpha/L$ in relation to the speed of conveyance of the conveyor chain 100. This allows proper stacking of the signatures 6 in the stacking section 200.

In the case of still another embodiment where the length of the first conveyor mechanism 700 associated with the first conveyance path 33 and the length of the second conveyor mechanism 800 associated with the second conveyance path 34 are shortened to thereby render configuration more compact, the speed of conveyance of the first conveyor mechanism 700 and the speed of conveyance of the second conveyor mechanism 800 may be reduced to respectively appropriate degrees in relation to the speed of conveyance of the conveyor chain 100. This allows proper stacking of the signatures 6 in the stacking section 200.

In the case of a further embodiment where the first deceleration mechanism 741 and the second deceleration mechanism 841 are not employed, the first conveyor mechanism 700 and the second conveyor mechanism 800 may be controlled such that their operating speed is temporarily reduced so as to decelerate conveyance of the first signature 71 and subsequent signatures 6 in the row-of-signatures 7 conveyed thereon. This allows proper stacking of the signatures 6 in the stacking section 200.

The first signature delivery section 300 and the second signature delivery section 400 are provided in opposition to an opening portion of the stacking space 201. As shown in FIGS. 2 and 3, the first signature delivery section 300 assumes the form of a pair of upper and lower conveyors. A lower conveyor 311 includes the upstream roller 312, the downstream roller 313 located in the vicinity of one side of the opening portion of the stacking space 201, and an endless conveyor belt 314 looped around and mounted on the rollers 312 and 313.

A conveyance surface 315 of the endless conveyor belt 314 is appropriately sloped downward toward the stacking space 201. An upper conveyor 321 is located above the lower conveyor 311 and includes an upstream roller 322, the downstream roller 323, and an endless conveyor belt 234. The upstream roller 322 is located further upstream of the upstream roller 312 of the lower conveyor 311. The downstream roller 323 is located above and in the proximity of the downstream roller 313 of the lower conveyor 311. The endless conveyor belt 234 is looped around and mounted on the rollers 322 and 323 while being located in the proximity of the conveyance surface 315.

As shown in FIGS. 2 and 4, the second signature delivery section 400 is disposed substantially symmetrically with the first signature delivery section 300, with the opening portion of the stacking space 201 interposed therebetween. The second signature delivery section 400 assumes the form of a pair of upper and lower conveyors. A lower conveyor 411 includes the upstream roller 412, the downstream roller 413 located in the vicinity of the other side of the opening portion of the stacking space 201, and an endless conveyor belt 414 looped around and mounted on the rollers 412 and 413.

A conveyance surface 415 of the endless conveyor belt 414 is appropriately sloped downward toward the stacking space 201.

An upper conveyor 421 is located above the lower conveyor 411 and includes an upstream roller 422, the downstream roller 423, and an endless conveyor belt 424. The upstream roller 422 is located further upstream of the upstream roller 412 of the lower conveyor 411. The downstream roller 423 is located above and in the proximity of the downstream roller 413 of the lower conveyor 411. The endless conveyor belt 424 is looped around and mounted on the rollers 422 and 423 while being located in the proximity of the conveyance surface 415.

Figure 10B:
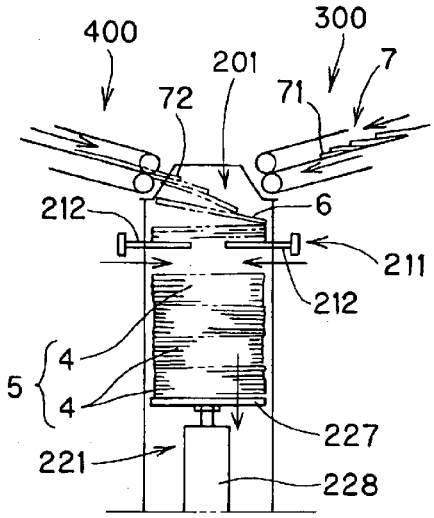
Figure 11:
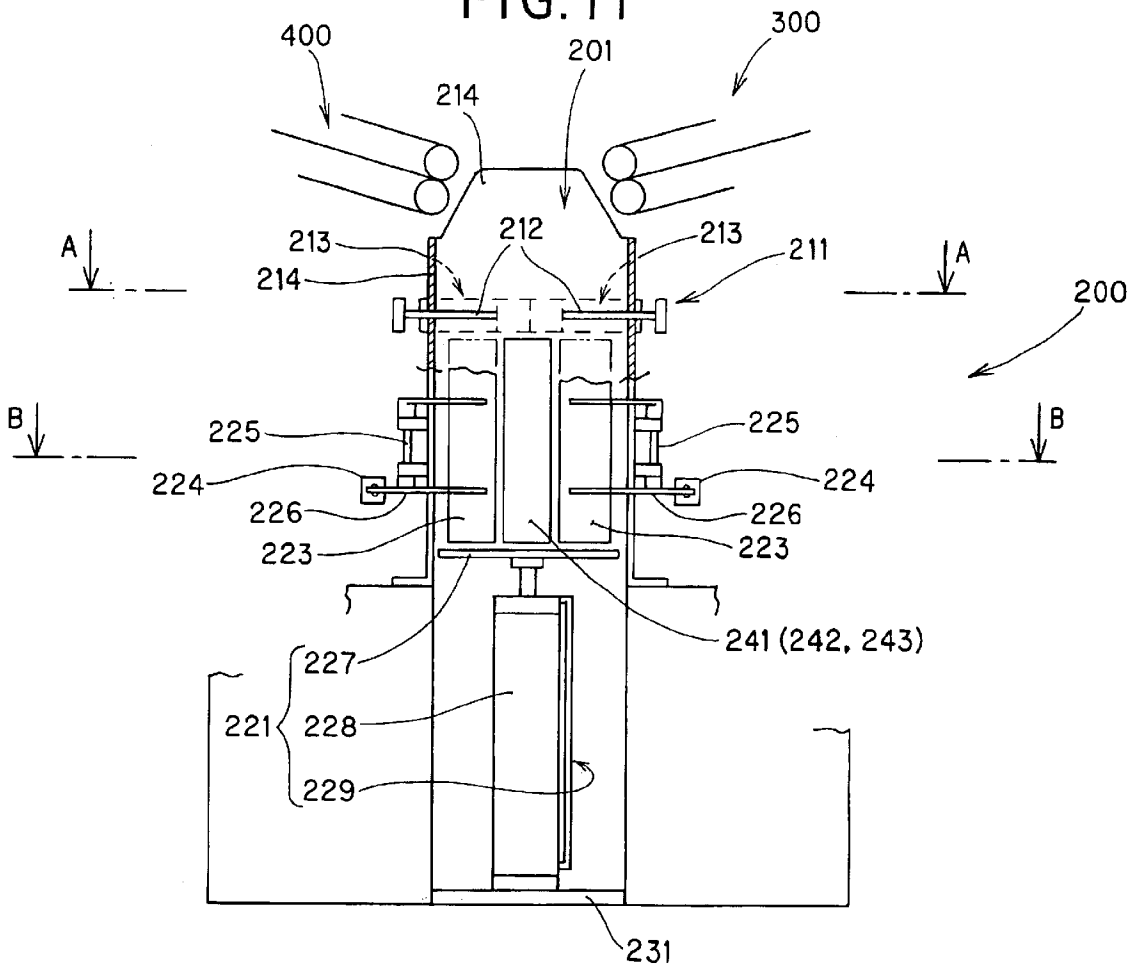
FIG. 11 is a partial front view showing first and second signature delivery sections and the stacking section in the signature-stacking apparatus shown in FIG. 1.
Figure 12:
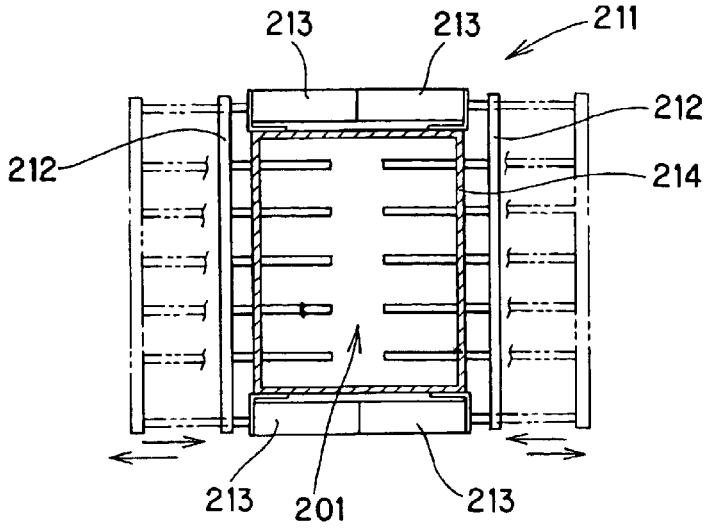
FIG. 12 is a plan view of a temporary reception mechanism as viewed in the direction of arrow A—A of FIG. 11.

As shown in FIGS. 1 and 2, the stacking section 200 includes (A) the stacking space 201 surrounded by a signature guide member 214 (see FIGS. 11 and 12); (B) a table mechanism 221 vertically movable in the stacking space 201 and capable of stacking on its stacking surface the signatures 6 that are delivered into the stacking space 201 from the first signature delivery section 300 and the second signature delivery section 400 and fall in the stacking space 201 (see FIG. 10A); (C) a temporary reception mechanism 211 provided above the stacking surface of the vertically moving table mechanism 221 and capable of temporarily receiving the group-of-signatures 4 that has been delivered into the stacking space 201 from the first signature delivery section 300 and the second signature delivery section 400 and fall thereon (see FIG. 10B); and (D) an unloading mechanism 241 for unloading a stack 5 of the signatures 6 on the stacking surface of the table mechanism 221 from the stacking space 201 to the exterior of the apparatus.

Figure 13:
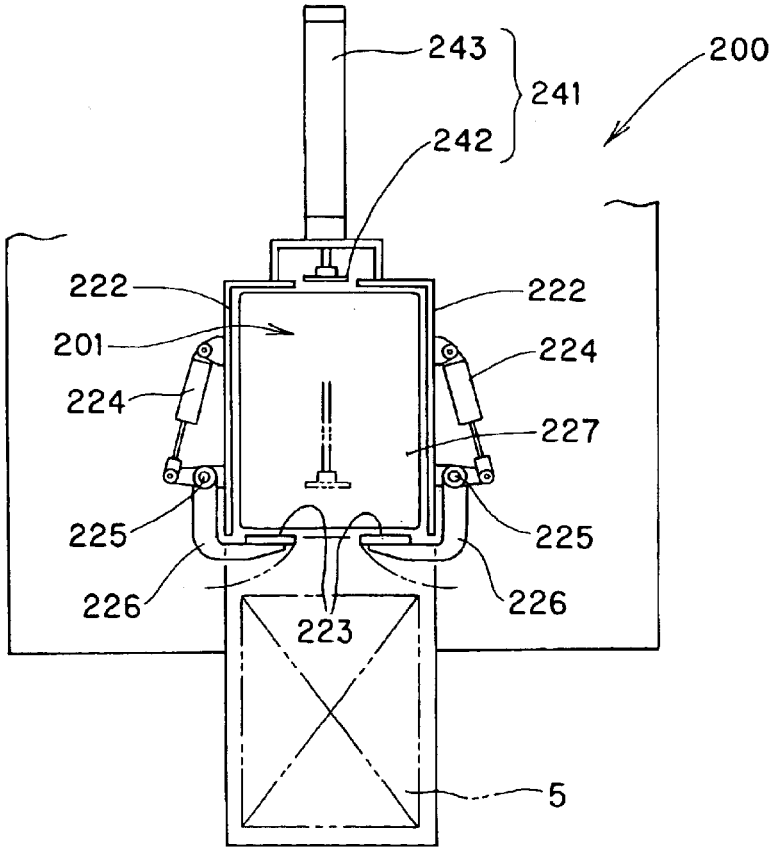
FIG. 13 is a plan view of an unloading mechanism as viewed in the direction of arrow B—B of FIG. 11.

The signature guide member 214, which surrounds the stacking space 201 (having a rectangular cross section in FIG. 13), is divided into an upper section and a lower section. The upper section of the signature guide member 214 surrounds the stacking space 201 from all of four sides. As shown in FIGS. 12 and 13, the lower section of the signature guide member 214 surrounds the stacking space 201 from three sides while the remaining one side, which corresponds to a short side of the rectangular cross section, is left open.

Two opposed side walls of the lower section of the signature guide member 214 (which side walls correspond to opposed long sides of the rectangular cross section) serve as a stack guide member 222 for guiding side portions of the stack 5 of the signatures 6 when the stack 5 is unloaded from the stacking space 201. Two openable gate members 223 are provided at the open side of the lower section of the signature guide member 214. When the stack 5 of the signatures 6 is to be unloaded to the exterior of the apparatus, the two gate members 223 are opened to form an unloading opening.

Notably, the stacking space 201 may be opened at a side of the lower section of the signature guide member 214 corresponding to a long side, not a short side, of the rectangular cross section.

Means for opening each of the gate members 223 is configured, for example, as follows. One end of a bell crank 226 is attached to the gate member 223. An intermediate portion of the bell crank 226 is rotatably attached to a shaft 225 provided on the outer surface of the stack guide member 222. The other end of the bell crank 226 is pin-connected to the distal end of a piston rod of a gate-drive pneumatic cylinder 224, whose end portion is pin-connected to the stack guide member 222.

The unloading mechanism 241 is provided in a retractable condition in relation to the stacking space 201 at a central portion of a side wall of the stack guide member 222, which side wall faces the open side where the two gate members 223 are provided.

As shown in FIGS. 11 and 13, the unloading mechanism 241 includes a pusher member 242 and pusher drive means. The pusher member 242 is adapted to push out the stack 5 of the signatures 6 on the table mechanism 221 from the stacking space 201 through the open side of the lower section of the signature guide member 214. The pusher drive means is, for example, a pusher-drive pneumatic cylinder 243 and is adapted to cause the pusher member 242 to advance into and retract from the stacking space 201.

As shown in FIGS. 11 and 12, the temporary reception mechanism 211 is provided at a boundary region between the upper section and the lower section of the signature guide member 214. The temporary reception mechanism 211 includes a pair of horizontally disposed comb-like temporary reception members 212 and two pairs of temporary-reception drive means. The paired temporary reception members 212 are provided on the corresponding opposed side walls of the upper section of the signature guide member 214 (the opposed side walls correspond to the opposed side walls of the lower section of the signature guide member 214 where the unloading opening is not present; i.e., the opposed side walls correspond to the opposed long sides of the rectangular cross section of the stacking space 201) such that respective teeth portions can advance into and retreat from the stacking space 201 in a mutually facing condition. The two pairs of temporary-reception drive means are provided on the opposed side walls of the upper section of the signature guide member 214 where the temporary reception members 212 are not provided, and are adapted to drive the paired temporary reception members 212 in an advancing-retreating manner. The two pairs of temporary-reception drive means are, for example, two pairs of temporary-reception pneumatic cylinders 213.

The teeth portions of the paired comb-like temporary reception members 212 advance into and retreat from the stacking space 201 in a mutually facing condition through the opposed side walls of the upper section of the signature guide member 214. In order to allow such movement of the teeth portions, each of the opposed side walls has a row of horizontally elongated holes or assumes the form of vertical lattice. Horizontal frame portions of the paired comb-like temporary reception members 212 are located outside the opposed side walls, and their opposite ends are connected to the corresponding distal ends of piston rods of the four temporary-reception pneumatic cylinders 213.

When the row-of-signatures 7 delivered into and falling in the stacking space 201 is to be temporarily sacked, the teeth portions of the paired temporary reception members 212 advance into the stacking space 201 to become ready for staking. When such temporary stacking is not performed, the teeth portions retreat from the stacking space 201.

As shown in FIGS. 10B, 11, and 13, the table mechanism 221 defines a bottom portion of the stacking space 201 and includes a table member 227 and lifting/lowering means. The upper surface of the table member 227 serves as a stacking surface for stacking the signatures. The lifting/lowering means supports the table member 227 and causes the table member 227 to be lifted or lowered. The lifting/lowering means is, for example, a lifting/lowering linear motor 228 having a table position detector 229. One end of the lifting/lowering linear motor 228 is attached to a frame 231 of a lower portion of the stacking section 200 such that the lifting/lowering linear motor 228 stands upright. To the other end of the lifting/lowering linear motor 228 is attached the table member 227 in a vertically movable condition in FIG. 11.

The table position detector 229 detects at all times the vertical position of the table member 227; i.e., the position of the table member 227 that is being lifted or lowered.

The control means CS for controlling a signature-stacking apparatus according to an embodiment of the present invention is composed of the conveyance control section C and the stacking control section S. The control means CS controls operation of the signature-stacking apparatus 10 on the basis of the stack information T that is preset in relation to stacking of the signatures 6.

As shown in FIG. 14, the stacking control section S receives the preset stack information T from, for example, an unillustrated process control CPU. The stacking control section S inputs the number-of-signatures-in-a-group signal S2 to the conveyance control section C; a second deceleration signal S82 to the drive unit (servomotor) 848 of the second deceleration mechanism 841; a temporary-reception drive signal S3 to the pneumatic cylinders 213 of the temporary reception mechanism 211; a gate signal S6 to the gate-drive pneumatic cylinders 224; a pusher signal S7 to the pusher-drive pneumatic cylinder 243; a table drive signal S4 to the lifting/lowering linear motor 228; a first deceleration signal S81 to the drive unit 748 of the first deceleration mechanism 741; and a conveyor drive signal Si to the drive unit 739 of the lower conveyor 411. The stacking control section S also receives a table position signal S5 from the table position detector 229.

The conveyance control section C receives the signature detection signal C2 from the signature detector 514 of the first signature release section 500. The conveyance control section C outputs a release signal C3 to the first drive members 512 of the first signature release section 500; a release guide signal C4 to the first release guides 513; and a conveying-speed signal C1, a signature synchronization shift signal C5, and a number-of-signatures-in-a-group request signal C6 to the stacking control section S.

Operation of a signature-stacking apparatus according to the embodiment of the present invention will be described with reference to the drawings while mentioning a flow of operation effected by the control means CS, which controls the signature-stacking apparatus 10.

First, the conveyance control section C and the stacking control section S are started. Next, the stack information T in relation to planned processing is input to the stacking control section S from, for example, an unillustrated process control CPU.

In this condition, when the rotary printing press starts operating, the signature-stacking apparatus 10 starts operating. As shown in FIG. 2, the drive unit 32 causes the conveyor chain 100 having the gripping mechanisms 121 to travel in a circulating condition while passing the signature-gripping station 2 of the folding unit 1, the first signature release section 500, and the second signature release section 600.

When the signature-stacking apparatus 10 starts operating, the paired temporary reception members 212 stand by while being advanced in the stacking space 201 so as to enable stacking of the signatures 6, and the table member 227 stands by at the bottom position of its vertical stroke (see FIG. 11). On the basis of an unillustrated encoder signal that is output from the drive unit 32, which is a motor having an encoder, in association with travel of the conveyor chain 100, the conveyance control section C outputs the conveying-speed signal C1 to the stacking control section S.

Upon reception of the conveying-speed signal C1, the stacking control section S outputs the conveyor drive signal S1 to the drive unit 739 of the first conveyor 711. As soon as the rotary printing press starts operating, the conveyance control section C outputs the number-of-signatures-in-a-group request signal C6. In response to the number-of-signatures-in-a-group request signal C6, the stacking control section S outputs the number-of-signatures-in-a-group signal S2 to the conveyance control section C.

In the signature-gripping station 2, the gripping mechanisms 121 of the started conveyor chain 100 successively grip the corresponding signatures 6, which are delivered successively from the folding unit 1, and convey the signatures 6 toward the first and second signature release sections 500 and 600. In the first signature release section 500 and the second signature release section 600, the conveyed signatures 6 are released from the gripping mechanisms 121 in a predetermined number alternately between the first signature release section 500 and the second signature release section 600.

Figure 5:
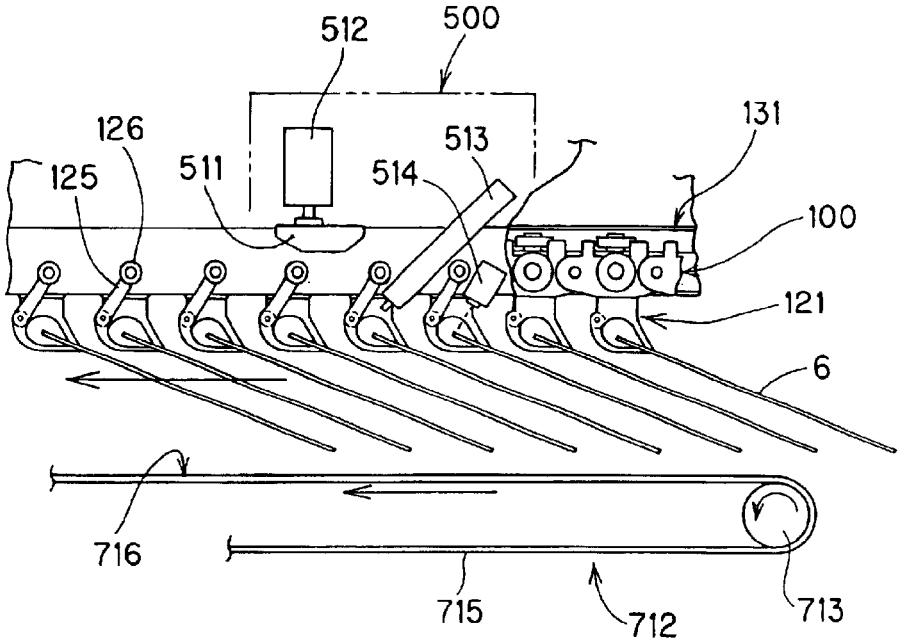
FIG. 5 is a partially enlarged view showing a first signature release section and a first signature reception section as viewed when release of signatures is deactivated.
Figure 6:
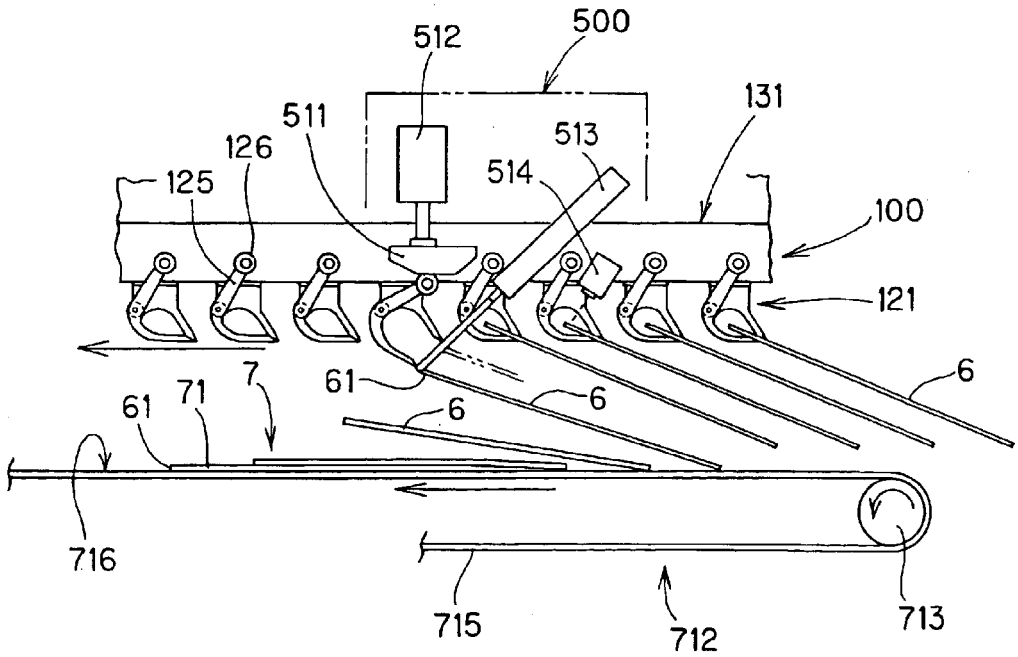
FIG. 6 is a partially enlarged view showing the first signature release section and the first signature reception section as viewed when release of signatures is activated.

Specifically, as shown in FIGS. 5 and 6, the signature detector 514 detects the first signature 6 that has been conveyed while being gripped by the corresponding gripping mechanism 121 of the conveyor chain 100. When the signature detection signal C2 associated with the first signature 6 is input to the conveyance control section C, the conveyance control section C calculates the distance of travel of the conveyor chain 100 on the basis of the encoder signal received from the drive unit 32. When the obtained distance of travel coincides with the length of a portion of the conveyance path 31 extending from the signature detector 514 to the paired first release members 511, the conveyance control section C outputs the release signal C3. The output release signal C3 causes the paired first drive members 512 to operate (the piston rods of the first drive pneumatic cylinders extend).

In the time between input of the signature detection signal C2 to the conveyance control section C and output of the release signal C3 from the conveyance control section C, the gripping mechanism 121 that holds the signature 6 detected by the signature detector 514 reaches the position of the paired first release members 511. The paired first release members 511, which are connected to the corresponding first drive members 512 (to the corresponding piston rod ends of the first drive pneumatic cylinders), press down the corresponding cam followers 126 of the gripping mechanism 121 that pass underneath, thereby causing the movable gripping member 123 to open for release of the signature 6.

The conveyance control section C outputs the release guide signal C4 substantially simultaneously with output of the release signal C3. The release guide signal C4 causes the paired first release guides 513 to operate (the piston rods of the first guide pneumatic cylinders extend such that side portions of the piston rods abut the leading end portion 61 of the signature 6), thereby obstructing free movement of the signature 6 for guiding-the signature 6 to the first signature reception section 712.

When the number of signature detection signals C2, which the signature detector 514 outputs in one-to-one correspondence with the signatures 6, coincides with the predetermined number of signatures 6 that constitute the group-of-signatures 4, the conveyance control section C calculates the distance of travel of the conveyor chain 100 on the basis of the encoder signal output from the drive unit 32. When the obtained distance of travel coincides with the length of a portion of the conveyance path 31 extending from the signature detector 514 to the paired first release members 511, the conveyance control section C turns off the release signal C3 and the release guide signal C4.

When the release signal C3 and the release guide signal C4 are turned off, the paired first drive members 512 and the paired first release guides 513 undergo a return action (the piston rods of the pneumatic cylinders retract); i.e., the guide portions of the first release members 511 and those of the first release guides 513 rise.

The subsequent gripping mechanisms 121 of the conveyor chain 100 pass the first signature release section 500 while gripping the corresponding signatures 6 and convey the signatures 6 to the second signature release section 600 in the second conveyance path 34. In the second signature release section 600, the stationary paired second release members 611 cause the cam followers 126 of the gripping mechanisms 121 to be pressed down at all time, thereby opening the movable gripping members 123 for release of the signatures 6. The stationary paired second release guides 612 abut the leading end portion 61 of each of the signatures 6, thereby obstructing free movement of the signature 6 for guiding the signature 6 to the second signature reception section 812.

The signature detector 514 continues detecting the signatures 6 conveyed along the second conveyance path 34. When the number of signature detection signals C2, which the signature detector 514 outputs in one-to-one correspondence with the signatures 6, coincides with the predetermined number of signatures 6 that constitute the group-of-signatures 4, the conveyance control section C calculates the distance of travel of the conveyor chain 100 on the basis of the encoder signal output from the drive unit 32.

When the obtained distance of travel coincides with the length of a portion of the conveyance path 31 extending from the signature detector 514 to the paired first release members 511, the conveyance control section C outputs the release signal C3. As mentioned previously, the output release signal C3 causes the paired first drive members 512 to operate (the piston rods of the first drive pneumatic cylinders extend), thereby releasing each of the subsequent signatures 6 in the first signature release section 500. In other words, when each of the gripping mechanisms 121 that grip the subsequent corresponding signatures 6 reaches the position of the paired first release members 511, the paired first release members 511 press down the corresponding cam followers 126 of the gripping mechanism 121 that pass underneath, thereby causing the movable gripping member 123 to open for release of the signature 6.

The conveyance control section C outputs the release guide signal C4 substantially simultaneously with output of the release signal C3. The release guide signal C4 causes the paired first release guide 513 to operate (the piston rods of the first guide pneumatic cylinders extend such that side portions of the piston rods abut the leading end portion 61 of the signature 6), thereby obstructing free movement of the signature 6 for guiding the signature 6 to the first signature reception section 712.

The conveyance control section C starts outputting the signature synchronization shift signal C5 to the stacking control section S simultaneously with the first output of the release signal C3. The signature synchronization shift signal C5 is a signal that coincides with the aforementioned encoder signal or a signal obtained by dividing the encoder signal.

As shown in FIGS. 3 and 6, the signatures 6 that have been successively released in the first signature release section 500 fall on the first signature reception section 712 of the first conveyor mechanism 700 and lie in an overlapping condition. The signatures 6 lying in an overlapping condition are conveyed as the row-of-signatures 7. The first conveyor mechanism 700 travels while being controlled such that its speed of conveyance is substantially equal to that of the conveyor chain 100.

The first conveyor mechanism 700 conveys, by means of the first conveyor 711, the row-of-signatures 7 that has been received in the first signature reception section 712. In the course of conveyance, the first conveyor mechanism 700 appropriately decelerates conveyance of a leading portion of the row-of-signatures 7 by means of the first deceleration mechanism 741 (see FIGS. 9B to 9D). Subsequently, the first conveyor mechanism 700 delivers the signatures 6 into the stacking space 201 from the first signature delivery section 300, thereby causing the signatures 6 to fall in the stacking space 201. In other words, the stacking control section S calculates the distance of travel of the first conveyor 711 on the basis of the signature synchronization shift signal C5 received from the conveyance control section C, thereby tracking the position of the first signature 71 of the row-of-signatures 7 conveyed by means of the first conveyor mechanism 700.

When the first signature 71 of the row-of-signatures 7, which first signature 71 is being tracked reaches a predetermined position in the upstream vicinity of the first deceleration mechanism 741, the stacking control section S outputs the first deceleration signal S81. In response to the first deceleration signal S81, the drive unit (servomotor) 748 of the first deceleration mechanism 741 rotates so as to project the two projections 742 upright from the conveyance surface 738, and then halts temporarily (see FIG. 9B).

Then, when the position of the leading end portion 61 of the first signature 71, which position is calculated as mentioned above, coincides with the position of the two projections 742, the first deceleration signal S81 is again output. The drive unit (servomotor) 748 resumes operating. The first deceleration mechanism 741 moves downstream at a speed slower than the speed of conveyance of the first conveyor 711 (see FIG. 9C), thereby braking conveyance of a plurality of signatures 6 that occupy a leading portion of the row-of-signatures 7 in contact with the two projections 742, and thus decreasing their overlapping pitch (see FIG. 9D).

When the two projections 742 move by half of the loop length of the first deceleration mechanism 741 after their start of travel, the two projections 742 hide under the conveyance surface 738. The leading portion of the row-of-signatures 7 resumes being conveyed at the speed of conveyance of the first conveyor 711 (see FIG. 9E). The row-of-signatures 7 is delivered into the stacking space 201 via the first signature delivery section 300 and falls in the stacking space 201. The falling signatures 6 are received on the paired temporary reception members 212 on standby of the temporary reception mechanism 211 and are temporarily stacked to form the first group-of-signatures 4.

In the first signature-stacking work after start of conveyance from the folding unit 1, the stacking control section S continues tracking the position of the row-of-signatures 7 on the basis of the signature synchronization shift signal C5 while taking into consideration the distance of decelerated travel effected by the first deceleration mechanism 741 and the distance of travel effected by the first signature delivery section 300. The stacking control section S outputs the table drive signal S4 at the timing when the first signature 71 delivered from the first signature delivery section 300 is received on the paired temporary reception members 212.

The table drive signal S4 causes the lifting/lowering linear motor 228 to operate, thereby causing the table member 227, which is initially situated at the bottom position of its vertical stroke, to rise to a position located just under the paired temporary reception members 212. When the distance of travel of the signature 6 calculated by the stacking control section S becomes a value indicating that a predetermined number of signatures 6 have been delivered from the first signature delivery section 300 and stacked on the temporary reception mechanism 211, the stacking control section S outputs the temporary-reception drive signal S3. The temporary-reception drive signal S3 causes the four temporary-reception pneumatic cylinders 213 to operate, thereby causing the paired temporary reception members 212 to retreat from the stacking space 201 (see FIG. 10D).

As a result of retreat of the paired temporary reception members 212 from the stacking space 201, the group-of-signatures 4 on the paired temporary reception members 212 falls onto the table member 227. Subsequently, the table member 227 lowers gradually while allowing the subsequent signatures 6 delivered into the stacking space 201 to be stacked thereon, and maintaining the top of the stack 5 at a substantially constant level.

Meanwhile, the signatures 6 that have passed the first signature release section 500 while being gripped by the corresponding gripping mechanisms 121 of the conveyor chain 100 (see FIG. 5) pass the twisted section 132 of the conveyor chain 100, where the conveyance path of the signatures 6 is twisted by 180 degrees about the direction of conveyance (see FIG. 2); pass a curved portion of the conveyor chain 100, where the direction of guiding the signatures 6 is changed by 180 degrees about an axis in parallel with the connection pin 113 of the conveyance chain 100; reach the second signature release section 600 as shown in FIG. 4; and are released by means of the second signature release section 600 to thereby lie on the second signature reception section 812 as shown in FIG. 7.

As shown in FIG. 4, the second conveyor mechanism 800, which travels while being controlled such that its speed of conveyance is substantially equal to that of the conveyor chain 100, conveys, by means of the second conveyor 811, the row-of-signatures 7 that has been received in the second signature reception section 812. In the course of conveyance, the second conveyor mechanism 800 appropriately decelerates conveyance of a leading portion of the row-of-signatures 7 by means of the second deceleration mechanism 841. Subsequently, the second conveyor mechanism 800 delivers the signatures 6 into the stacking space 201 from the second signature release section 400, thereby causing the signatures 6 to fall in the stacking space 201. The falling signatures 6 are stacked on the group-of-signatures 4 that has being previously delivered from the first signature delivery section 300 and stacked, such that their orientation differs on a plane by 180 degrees from the orientation of the previously stacked group-of-signatures 4 (see FIG. 10A).

In other words, as in the case of the first conveyor mechanism 700, the stacking control section S calculates the distance of travel of the second conveyor 811 on the basis of the signature synchronization shift signal C5 received from the conveyance control section C, thereby tracking the position of the first signature 71 of the row-of-signatures 7 conveyed by means of the second conveyor mechanism 800. When the first signature 71 of the row-of-signatures 7, which first signature 71 is being tracked, reaches a predetermined position in the upstream vicinity of the second deceleration mechanism 841, the stacking control section S outputs the second deceleration signal S82. In response to the second deceleration signal S82, the drive unit (servomotor) 848 of the second deceleration mechanism 841 rotates so as to project the two projections 842 upright from the conveyance surface 838, and then halts temporarily.

Then, when the position of the leading end portion 61 of the first signature 71, which position is calculated as mentioned above, coincides with the position of the two projections 842, the second deceleration signal S82 is again output. The drive unit (servomotor) 848 resumes operating. The second deceleration mechanism 841 moves downstream at a speed slower than the speed of conveyance of the second conveyor 811, thereby braking conveyance of a plurality of signatures 6 that occupy a leading portion of the row-of-signatures 7 in contact with the two projections 842, and thus decreasing their overlapping pitch.

When the two projections 842 move by half of the loop length of the second deceleration mechanism 841 after their start of travel, the two projections B42 hide under the conveyance surface 838. The leading portion of the row-of-signatures 7 resumes being conveyed at the speed of conveyance of the second conveyor 811. The row-of-signatures 7 is delivered into the stacking space 201 via the second signature delivery section 400 and falls in the stacking space 201. The falling signatures 6 are stacked on the top of the previously stacked group-of-signatures 4.

In the illustrated present embodiment, the same distance of conveyance is established between conveyance from the first signature release section 500 to the downstream rollers 313 and 323 of the first signature delivery section 300 and conveyance by the conveyor chain 100 from the first signature release section 500 to the second signature release section 600 plus conveyance from the second signature release section 600 to the downstream rollers 413 and 423 of the second signature delivery section 400. Thus, in order to prevent interference between the last signature 72 of the row-of-signatures 7 delivered into the stacking space 201 from one signature delivery section and the first signature 71 of the row-of-signatures 7 delivered into the stacking space 201 from the other signature delivery section, the first deceleration mechanism 741 or the second deceleration mechanism 841 decelerates a leading portion of the corresponding row-of-signatures 7.

In other words, when L represents the length of the signature 6 as measured along the direction of conveyance, P represents the overlapping pitch of the signatures 6, and L=4×P, by means of decelerating the signatures 6 that occupy a leading portion of the row-of-signatures 7, by a length of 2×P (which is 50% of the length L of the signature 6), a delay of L/2 is present between delivery of the last signature 72 of the row-of-signatures 7 delivered from one direction into the stacking space 201 and delivery of the fist signature 71 of the row-of-signatures 7 delivered from the opposite direction into the stacking space 201.

Accordingly, interference between the first signature 71 and the last signature 72 that are delivered from mutually opposite directions can be completely avoided. The previously stacked last signature 72 is overlaid with the first signature 71 that is delivered from the opposite direction and falls. The last signature 72 and the first signature 71 are stacked in mutually opposite orientations.

Subsequently, a predetermined number of the signatures 6 are delivered into the stacking space 201 alternately from the first signature delivery section 300 and the second signature delivery section 400. The thus-delivered signatures 6 are stacked on the upper surface of the table member 227.

When the groups-of-signatures 4 are stacked in alternate orientations on the table member 227, and as a result the number of signatures 6 in the resultant stack 5 reaches a predetermined value, the stacking control section S outputs the table drive signal S4. The table drive signal S4 causes the lifting/lowering linear motor 228 to operate, whereby the table member 227 rapidly lowers to the bottom position of its vertical stroke (see FIG. 10B).

Substantially synchronously with output of the table drive signal S4, the stacking control section outputs the temporary-reception drive signal S3. The temporary-reception drive signal S3 causes the four temporary-reception pneumatic cylinders 213 to operate. As a result, the paired temporary reception members 212 advance into the stacking space 201 during an interval between delivery of the last signature 72 delivered from either the first signature delivery section 300 or the second signature delivery section 400 and delivery of the first signature 71 delivered from the counterpart signature delivery section 300 or 400, which interval is produced by the first deceleration mechanism 741 and the second deceleration mechanism 841 as described previously (see FIG. 10B).

In other words, when the signature 6 that the stacking control section S is tracking by means of calculation on the basis of the signature synchronization shift signal C5 is conveyed over a predetermined distance, the stacking control section S judges that a predetermined number of signatures 6 have been delivered from the first signature delivery section 300 and the second signature delivery section 400, and outputs the table drive signal S4 and the temporary-reception drive signal S3. The table drive signal S4 causes the lifting/lowering linear motor 228 to operate, whereby the table mechanism 221 lowers the table member 227 to the bottom position of the vertical stroke of the table member 227 (see FIG. 10B).

The above-issued temporary-reception drive signal S3 causes the four temporary-reception pneumatic cylinders 213 to operate, whereby the paired temporary reception members 212 advance into the stacking space 201 so as to prevent the signatures 6 from being additionally stacked on the top of the stack 5 stacked on the table member 227 situated at the bottom position of its vertical stroke. For example, the paired temporary reception members 212 are inserted into the stacking space 201 during an interval between delivery of the last signature 72 from the first signature delivery section 300 and subsequent delivery of the first signature 71 from the second signature delivery section 400. The interval is equivalent to, for example, two pitches (two overlapping pitches) of the signatures 6. The first signature 71 and subsequent signatures 6 to be delivered from the second signature delivery section 400 are stacked on the paired temporary members 212 that have been inserted.

While the temporary reception mechanism 211 is allowing stacking thereon of the subsequent signatures 6, the table member 227 reaches the bottom position of its vertical stroke. The table position detector 229 outputs the table position signal S5 indicative of arrival of the table member 227 at the bottom position. Upon reception of the table position signal S5, the stacking control section S outputs the gate signal S6 and the pusher signal S7 successively. The gate signal S6 causes the paired gate-drive pneumatic cylinders 224 to operate, whereby the two gate members 223 are opened.

Figure 10C:
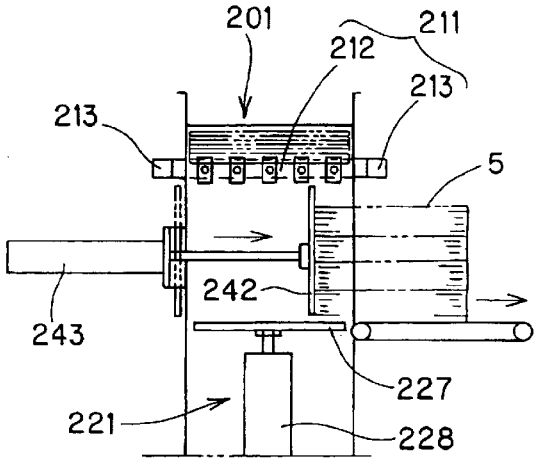

Next, the pusher signal S7 causes the pusher-drive pneumatic cylinder 243 to operate. As a result, the pusher member 242 of the unloading mechanism 241, which pusher member 242 has been on standby at the outside of the stack guide member 222, advances into the stacking space 201 and pushes out the stack 5 to the exterior of the apparatus (see FIGS. 10C and 13). Upon completion of pushing-out of the stack 5, the pusher signal S7 goes off, whereby the pusher member 242 retracts to its original position by means of reverse operation of the pusher-drive pneumatic cylinders 243.

In the course of retraction of the pusher member 242, the gate signal S6 goes off, whereby the paired gate members 223 are closed by means of reverse operation of the paired gate-drive pneumatic cylinders 224. After the paired gate members 223 are closed, the stacking control section S outputs the table drive signal S4, whereby the lifting/lowering linear motor 228 operates in the reverse direction to thereby rapidly lift the table member 227 to a position located immediately under the paired temporary reception members 212. Notably, for example, timers that are activated by the pusher signal S7 are used to trigger the following signal controls: the pusher signal S7 goes off; the gate signal S6 goes off; and the table drive signal S4 for operating the lifting/lowering linear motor 228 in the reverse direction is output. These signal controls are effected in response to completions of the clocking operations of the corresponding timers.

After the initial operation of stacking groups of signatures 6 on the table member 227 is completed, and the paired temporary reception members 212 advance into the stacking space 201, a subsequent row of signatures 6 delivered from the first signature delivery section 300 or subsequent rows of signatures 6 delivered from the first signature delivery section 300 and the second signature delivery section 400 fall and are stacked continuously on the paired temporary reception members 212.

At the time when the table member 227 rises and reaches a position located immediately under the paired temporary reception members 212, and then the last signature 72 of the row-of-signatures 7 have been delivered from the first signature delivery section 300 or the second signature delivery section 400 falls on the previously stacked signatures 6 of the row-of-signatures 7 on the paired temporary reception members 212, the stacking control section S outputs the temporary-reception drive signal S3. The temporary-reception drive signal S3 causes the four temporary-reception pneumatic cylinders 213 to operate, whereby the paired temporary reception members 212 retreat. As a result, the group-of-signatures 4 that has been stacked on the paired temporary reception members 212 is delivered onto the table member 227, which has been on standby at a position located immediately under the paired temporary reception members 212.

Figure 10D:
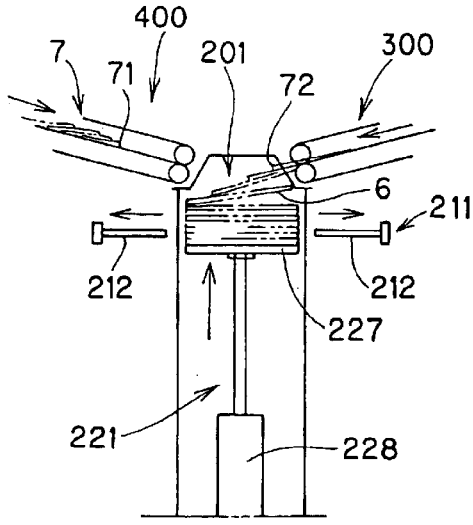

The table member 227 receives the group-of-signatures 4 that has been temporarily stacked on the paired temporary reception members 212, and begins to gradually lower while allowing stacking of the subsequently delivered signatures 6 (see FIG. 10D).

Subsequently, until completion of stacking of all the stacks 5 specified in the stack information T, the following set of operations is repeated: the table member 227 lowers rapidly, and the signatures 6 are temporarily stacked on the paired temporary reception members 212; the table member 227 rises, and the paired temporary reception members 212 retreat from the stacking space 201 to thereby deliver the group-of-signatures 4 onto the table member 227 from the paired temporary reception members 212; and the table member 227 lowers gradually while allowing stacking of the subsequently delivered signatures 6 on the group-of-signatures 4 that has been stacked on the table member 227.

Notably, at the time when all of the stacks 5 specified in the stack information T are stacked and unloaded to the exterior of the apparatus to thereby complete the stacking process or when the stacking process is interrupted, if the signatures 6 or the group-of-signatures 4 remain in the stacking space 201, the remaining signatures 6 or group-of-signatures 4 is unloaded to the exterior of the apparatus by operating unillustrated operation means. Subsequently, operation of the signature-stacking apparatus 10 is ended.

Obviously, numerous modifications and variations of the present invention are possible in light of the above teachings. It is therefore to be understood that within the scope of the appended claims, the present invention may be practiced otherwise than as specifically described herein.

What is claimed is:

1. A signature-stacking apparatus comprising:

a conveyor chain having a plurality of gripping mechanisms for holding corresponding signatures and adapted to convey the signatures held by the corresponding gripping mechanisms;

a guide member for guiding travel of the conveyor chain, the guide member and the conveyor chain forming a conveyance path for conveying signatures;

a first signature release section and a second signature release section disposed in this sequence in the conveyance path with a certain distance of conveyance present therebetween, the signatures being released from the corresponding gripping mechanisms in the first and second signature release sections;

a stacking section having an opening portion for receiving signatures, and a stacking space for stacking the received signatures, the stacked signatures being delivered, as a stack, from the stacking section;

a first signature delivery section corresponding to the first signature release section, and a second signature delivery section corresponding to the second signature release section, the first and second signature delivery sections being disposed on opposite sides of the opening portion of the stacking section, and alternately delivering the released signatures into the stacking space of the stacking section; and a first conveyor mechanism disposed between the first signature delivery section and a position located under the first signature release section, and a second conveyor mechanism disposed between the second signature delivery section and a position located under the second signature release section, the first conveyor mechanism conveying the signatures released from the first signature release section, and the second conveyor mechanism conveying the signatures released from the second signature release section;

wherein, in a portion of the conveyance path between the first signature release section and the second signature release section, the guide member is twisted by 180 degrees about the direction of travel of the conveyor chain and is curved such that the direction of conveyance of the conveyor chain makes a 180-degree turn about an axis parallel to a connection pin of the conveyor chain; and the first conveyor mechanism and the second conveyor mechanism are configured such that time between arrival at the first signature release section of a signature to be released from the first signature release section and delivery of the signature from the first signature delivery section is substantially equal to time between arrival at the first signature release section of a signature to be released from the second signature release section and delivery of the signature from the second signature delivery section, and in such a manner that the first and second conveyor mechanisms can be adjusted so as to prevent interference in the course of delivery between a signature delivered last from one signature delivery section and a signature delivered first from the other signature delivery section.

2. A signature-stacking apparatus according to claim 1, wherein the stacking section comprises a table mechanism adapted to receive and stack thereon signatures delivered into the stacking space and being vertically movable within the stacking space; a temporary reception mechanism provided above a signature-stacking surface of the table mechanism so as to temporarily receive signatures delivered into the stacking space from the first and second signature delivery sections; and a delivery mechanism for delivering signatures stacked on the signature-stacking surface of the table mechanism from the stacking space to the outside of the apparatus.

3. A signature-stacking apparatus according to claim 1, wherein at least either the first conveyor mechanism or the second conveyor mechanism has a signature-conveying speed equal to that of the conveyor chain; and at least one of the first conveyor mechanism and the second conveyor mechanism is selectively controlled such that its operating speed is temporarily reduced so as to prevent interference in the course of delivery between a signature delivered last from one signature delivery section and a signature delivered first from the other signature delivery section.

4. A signature-stacking apparatus according to claim 1, wherein the first conveyor mechanism and the second conveyor mechanism have a signature-conveying speed unequal to that of the conveyor chain; and at least one of the first conveyor mechanism and the second conveyor mechanism is selectively controlled such that its operating speed is temporarily reduced so as to prevent interference in the course of delivery between a signature delivered last from one signature delivery section and a signature delivered first from the other signature delivery section.

5. A signature-stacking apparatus according to claim 1, wherein at least either the first conveyor mechanism or the second conveyor mechanism has a signature-conveying speed equal to that of the conveyor chain; and the first conveyor mechanism has a first braking mechanism for temporarily braking conveyance of signatures conveyed on the first conveyor mechanism, and the second conveyor mechanism has a second braking mechanism for temporarily braking conveyance of signatures conveyed on the second conveyor mechanism, wherein the signature-conveying speeds of the first and second conveyor mechanisms are adjusted by means of the first and second braking mechanisms, respectively, so as to prevent interference in the course of delivery between a signature delivered last from one signature delivery section and a signature delivered first from the other signature delivery section.

6. A signature-stacking apparatus according to claim 1, wherein the first conveyor mechanism and the second conveyor mechanism have a signature-conveying speed unequal to that of the conveyor chain; and the first conveyor mechanism has a first braking mechanism for temporarily braking conveyance of signatures conveyed on the first conveyor mechanism, and the second conveyor mechanism has a second braking mechanism for temporarily braking conveyance of signatures conveyed on the second conveyor mechanism, wherein the signature-conveying speeds of the first and second conveyor mechanisms are adjusted by means of the first and second braking mechanisms, respectively, so as to prevent interference in the course of delivery between a signature delivered last from one signature delivery section and a signature delivered first from the other signature delivery section.

7. A signature-stacking apparatus according to claim 5, wherein each of the first braking mechanism and the second braking mechanism is a stopper mechanism for stopping conveyance of signatures.

8. A signature-stacking apparatus according to claim 5, wherein each of the first braking mechanism and the second braking mechanism is a deceleration mechanism for decelerating conveyance of signatures.

9. A signature-stacking apparatus according to claim 6, wherein each of the first braking mechanism and the second braking mechanism is a stopper mechanism for stopping conveyance of signatures.

10. A signature-stacking apparatus according to claim 6, wherein each of the first braking mechanism and the second braking mechanism is a deceleration mechanism for decelerating conveyance of signatures.

* * * * *